US007994996B2

(12) United States Patent
Rebeiz et al.

(10) Patent No.: US 7,994,996 B2
(45) Date of Patent: Aug. 9, 2011

(54) MULTI-BEAM ANTENNA

(75) Inventors: Gabriel Rebeiz, LaJolla, CA (US); James P. Ebling, Ann Arbor, MI (US); Bernhard Schoenlinner, Trostberg (DE)

(73) Assignee: TK Holding Inc., Electronics, Farmington Hills, MI (US)

( * ) Notice: Subject to any disclaimer, the term of this patent is extended or adjusted under 35 U.S.C. 154(b) by 455 days.

(21) Appl. No.: 11/627,369

(22) Filed: Jan. 25, 2007

(65) Prior Publication Data

US 2007/0195004 A1 Aug. 23, 2007

Related U.S. Application Data

(63) Continuation-in-part of application No. 10/907,305, filed on Mar. 28, 2005, now abandoned, and a continuation-in-part of application No. 11/161,681, filed on Aug. 11, 2005, now Pat. No. 7,358,913, which is a continuation-in-part of application No. 10/604,716, filed on Aug. 12, 2003, now Pat. No. 7,042,420, which is a continuation-in-part of application No. 10/202,242, filed on Jul. 23, 2002, now Pat. No. 6,606,077, which is a continuation-in-part of application No. 09/716,736, filed on Nov. 20, 2000, now Pat. No. 6,424,319.

(60) Provisional application No. 60/521,284, filed on Mar. 26, 2004, provisional application No. 60/522,077, filed on Aug. 11, 2004, provisional application No. 60/166,231, filed on Nov. 18, 1999.

(51) Int. Cl.
*H01Q 19/06* (2006.01)

(52) U.S. Cl. ..... 343/754; 343/700 MS; 343/753

(58) Field of Classification Search ..... 343/700 MS, 343/753, 754, 767, 770
See application file for complete search history.

(56) References Cited

U.S. PATENT DOCUMENTS 3,170,158 A 2/1965 Rotman et al.

(Continued)

FOREIGN PATENT DOCUMENTS

EP 0 483 686 B1 4/1996

(Continued)

OTHER PUBLICATIONS

Simmons et al., "Radial Microstrip Slotline Feed Network for Circular Mobile Communications Array," in 1994 IEEE AP-S Int. Symp. Dig., Seattle, WA, Jun. 1994, 1024-1027.

(Continued)

*Primary Examiner* — Tho G Phan
(74) *Attorney, Agent, or Firm* — Raggio & Dinnin, P.C.

(57) ABSTRACT

A plurality of antenna elements on a dielectric substrate are adapted to launch or receive electromagnetic waves in or from a direction substantially away from either a convex or concave edge of the dielectric substrate, wherein at least two of the antenna elements operate in different directions. Slotlines of tapered-slot endfire antennas in a first conductive layer of a first side of the dielectric substrate are coupled to microstrip lines of a second conductive layer on the second side of the dielectric substrate. A bi-conical reflector, conformal cylindrical dielectric lens, or discrete lens array improves the H-plane radiation pattern. Dipole or Yagi-Uda antenna elements on the conductive layer of the dielectric substrate can be used in cooperation with associated reflective elements, either alone or in combination with a corner-reflector of conductive plates attached to the conductive layers proximate to the endfire antenna elements.

9 Claims, 25 Drawing Sheets

U.S. PATENT DOCUMENTS

| | | | | | |
|---|---|---|---|---|---|
| 3,713,163 | A | | 1/1973 | Keller et al. | |
| 3,754,270 | A | | 8/1973 | Thies | |
| 3,761,936 | A | | 9/1973 | Archer et al. | |
| 3,852,761 | A | * | 12/1974 | Bogner | 343/754 |
| 3,984,840 | A | | 10/1976 | Dell-Imagine | |
| 4,087,822 | A | | 5/1978 | Maybell et al. | |
| 4,131,896 | A | * | 12/1978 | Miller | 343/815 |
| 4,222,054 | A | | 9/1980 | Capps | |
| 4,268,831 | A | | 5/1981 | Valentino et al. | |
| 4,288,795 | A | | 9/1981 | Shelton | |
| 4,348,678 | A | | 9/1982 | Thomas | |
| 4,381,509 | A | | 4/1983 | Rotman et al. | |
| 4,568,944 | A | * | 2/1986 | Cassel | 343/802 |
| 4,641,144 | A | | 2/1987 | Prickett | |
| 4,845,507 | A | | 7/1989 | Archer et al. | |
| 4,905,014 | A | | 2/1990 | Gonzalez et al. | |
| 5,099,253 | A | | 3/1992 | Archer | |
| 5,274,389 | A | | 12/1993 | Archer et al. | |
| 5,347,287 | A | | 9/1994 | Speciale | |
| 5,428,364 | A | | 6/1995 | Lee et al. | |
| 5,446,470 | A | | 8/1995 | Avingnon et al. | |
| 5,486,832 | A | | 1/1996 | Hulderman | |
| 5,576,721 | A | | 11/1996 | Hwang et al. | |
| 5,583,511 | A | | 12/1996 | Hulderman | |
| 5,712,643 | A | | 1/1998 | Skladany | |
| 5,821,908 | A | | 10/1998 | Sreenivas | |
| 5,874,915 | A | | 2/1999 | Lee et al. | |
| 5,892,487 | A | | 4/1999 | Fujimoto et al. | |
| 5,894,288 | A | | 4/1999 | Lee et al. | |
| 5,913,549 | A | | 6/1999 | Skladany | |
| 5,926,134 | A | | 7/1999 | Pons et al. | |
| 5,933,109 | A | | 8/1999 | Tohya et al. | |
| 5,959,578 | A | | 9/1999 | Kreutel, Jr. | |
| 5,963,172 | A | | 10/1999 | Pfizenmaier et al. | |
| 6,031,483 | A | | 2/2000 | Urabe et al. | |
| 6,031,501 | A | | 2/2000 | Rausch et al. | |
| 6,037,894 | A | | 3/2000 | Pfizenmaier et al. | |
| 6,043,772 | A | | 3/2000 | Voigtlaender et al. | |
| 6,046,703 | A | | 4/2000 | Wang et al. | |
| 6,061,035 | A | | 5/2000 | Kinasewitz et al. | |
| 6,137,434 | A | | 10/2000 | Tohya et al. | |
| 6,198,449 | B1 | | 3/2001 | Muhlhauser et al. | |
| 6,317,094 | B1 | | 11/2001 | Wu et al. | |
| 6,362,788 | B1 | | 3/2002 | Louzir | |
| 6,424,319 | B2 | | 7/2002 | Ebling et al. | |
| 6,426,814 | B1 | | 7/2002 | Berger et al. | |
| 6,590,544 | B1 | | 7/2003 | Filipovic | |
| 6,606,077 | B2 | | 8/2003 | Ebling et al. | |
| 6,867,741 | B2 | | 3/2005 | Schaffner et al. | |
| 6,897,819 | B2 | | 5/2005 | Henderson et al. | |
| 6,982,676 | B2 | | 1/2006 | Sievenpiper et al. | |
| 7,042,420 | B2 | | 5/2006 | Ebling et al. | |
| 7,075,485 | B2 | | 7/2006 | Song et al. | |
| 7,358,913 | B2 | | 4/2008 | Ebling et al. | |
| 7,411,542 | B2 | | 8/2008 | O'Boyle | |
| 2005/0219126 | A1 | | 10/2005 | Rebeiz et al. | |
| 2006/0028386 | A1 | | 2/2006 | Ebling et al. | |
| 2007/0001918 | A1 | | 1/2007 | Ebling et al. | |
| 2008/0048921 | A1 | | 2/2008 | Ebling et al. | |
| 2008/0055175 | A1 | | 3/2008 | Rebeiz et al. | |

FOREIGN PATENT DOCUMENTS

| | | | | |
|---|---|---|---|---|
| EP | 0 427 470 | B1 | | 9/1996 |
| EP | 0 483 686 | B1 | | 5/2007 |
| GB | 2331185 | A | | 5/1999 |
| JP | 02113604 | A | * | 4/1990 |
| WO | 92/13373 | A1 | | 8/1992 |

OTHER PUBLICATIONS

Vaughan et al., "28 GHz Omni-Directinal Quasi-Optical Transmitter Array", IEEE Trans. Microwave Theory Tech., vol. 43, No. 10, Oct. 1995, pp. 2507-2509.

Vaughan et al., "Improved radiation pattern for 28 GHz omni-directional quasi-optical oscillator array," IEEE Antennas and Propagation Society International Symposium, Jun. 1995, vol. 3, pp. 1372-1375.

Vaughan et al., "InP-based 28 GHz integrated antennas for point-to-multipoint distribution", in IEEE Proc. Advanced Concepts in High Speed Semiconductor Devices and Circuits, Aug. 1995, pp. 75-84.

White et al.; "A wide-scan printed planar K-band microwave lens," Antennas and Propagation Society International Symposium, 2005 IEEE, vol. 4A, Jul. 3-8, 2005 pp. 313-316 vol. 4A.

Pozar et al., "Scan Blindness in Infinite Phased Arrays of Printed Dipoles," IEEE Trans. Antennas Prop., vol. AP-32, No. 6, pp. 602-610, Jun. 1984.

McGrath, D. T ., "Planar Three-Dimensional Constrained Lenses," IEEE Trans. Antennas Prop., vol. AP-34, No. 1, pp. 46-50, Jan. 1986.

Pozar, D. M., "Flat lens antenna concept using aperture coupled microstrip patches," Electronic Letters, vol. 32, pp. 2109-2111, Nov. 1996.

Pozar et al., "Design of Millimeter Wave Microstrip Reflectarrays," IEEE Trans. Antennas Prop., vol. 45, No. 2, pp. 287-296, Feb. 1997.

Gresham et al., "A compact manufactureable 76-77-GHz radar module for commercial ACC applications," IEEE Trans. on Microwave Theory and Techniques, vol. 49, No. 1, Jan. 2001, pp. 44-58.

Menzel et al., "A 76 GHz multiple-beam planar relfector antenna," 32nd European Microwave Conf. Proc., Sep. 2001, pp. 977-980.

Abbaspour-Tamijani et al., "AntennaFilterAtnenna Arrays as a Class of Bandpass Frequency-Selective Surfaces," IEEE Trans. Microwave Theory Tech., vol. 52, No. 8, pp. 1781-1789, Aug. 2004.

Barrow et al., "Biconical electromagnetic horns," in Proceedings IRE, Dec. 1939, vol. 27, pp. 769-779.

Siegel et al., "The Dielectric-Filled Parabola: A New Millimeter/Submillimeter Wavelength Receiver/Transmitter Front End," IEEE Transactions on Antennas and Propagation, vol. 39, No. 1, Jan. 1991, pp. 40-47.

Gouker et al., "A Millimeter-Wave Integrated-Circuit Antenna Based on the Fresnel Zone Plate," IEEE Transactions on Microwave Theory and Techniques, vol. 40, No. 5, May 1992, pp. 968-977.

Demmerle et al., "A bi-conical multibeam antenna for space division multiple access," IEEE Antennas and Propagation Society International Symposium, Montreal, Aug. 1997, pp. 1082-1085.

Wu et al., "Design and Characterization of Single and Multiple Beam MM-Wave Circularly Polarized Substrate Lens Antennas for Wireless Communications," IEEE Antennas and Propagation Society International Symposium, 1999 Digest, APS, Orlando, Florida, Jul. 11-16, 1999, New York, NY : IEEE, US, vol. 4, Jul. 11, 1999, pp. 2408-2411, XP000935569, ISBN: 0-7803-5640-3.

Abbaspour-Tamijani, A., "Novel Components for Integrated Millimeter-Wave Front-Ends," Ph.D. Dissertation, University of Michigan, Jan./Feb. 2004.

Office Action in U.S. Appl. No. 10/907,305, Mailed on Jul. 25, 2006.

PCT/US05/10596 International Search Report and Written Opinion of the International Searching Authority, Dec. 6, 2006, 10 pages.

Yngvesson et al., "The tapered slot antenna—a new integrated element for mm-wave applications," IEEE Trans. on Microwave Theory and Techniques, MTT-37, No. 2, Feb. 1989, pp. 365-374.

Schoenberg et al., "Two-Level Power Combining Using a Lens Amplifier," IEEE Transactions on Microwave Theory and Techniques, vol. 42, No. 12, Dec. 1994, pp. 2480-2485.

Hollung et al., "A Bi-Directional Quasi-Optical Lens Amplifier", IEEE Transactions on Microwave Theory and Techniques, vol. 45, No. 12, Dec. 1997, pp. 2352-2357.

Sugawara et al., "A mm-wave tapered slot antenna with improved radiation pattern," 1997 IEEE MTT-S Int. Micorwave Symp. Dig., Anaheim, CA, Jun. 1997, pp. 959-962.

Popovic et al.,"Quasi-Optical Transmit/Receive Front Ends", IEEE Transactions on Microwave Theory and Techniques, vol. 46, No. 11, Nov. 1998, pp. 1964-1975.

Deal et al., "A new quasi-yagi antenna for planar active antenna arrays," IEEE Trans. Microwave Theory Tech., vol. 48, No. 6, Jun. 2000, pp. 910-918.

Schoenlinner et al., "77 GHz Transceiver Module Using a Low Dielectric Constant Multilayer Structure," 30th European Microwave Conference Paris France 2.-6.10.2000, Oct. 2000, pp. 245-248.

Vian et al., "A Transmit/Receive Active Antenna with Fast Low-Power Optical Switching", IEEE Transactions on Microwave Theory and Techniques, vol. 48, No. 12, Dec. 2000, pp. 2686-2691.

Schoenlinner et al., "Spherical-Lens Antennas for Millimeter Wave Radars," European Microwave Week 2001 Proc., vol. 3, Sep. 2001, pp. 317-320.
Popovic et al., "Multibeam Antennas with Polarization and Angle Diversity", IEEE Transactions on Antennas and Propogation, vol. 50, No. 5, May 2002, pp. 651-657.
Schoenlinner et al., "Compact Multibeam Imaging Antenna for Automotive Radars," 2002 IEEE MTT-S Digest, Jun. 2002, pp. 1373-1376.
Schoenlinner et al., "Wide-Scan Spherical-Lens Antennas for Automotive Radars," IEEE Transactions on Microwave Theory and Techniques, vol. 50, No. 9, Sep. 2002, pp. 2166-2175.
Romisch et al., "Multi-Beam Discrete Lens Arrays with Amplitude Controlled Steering", IEEE International Microwave Symposium Digest, vol. 1-3, TH4B-1, Jun. 9-11, 2003, pp. 1669-1672.
Abbaspour-Tamijani et al.,"A planar filter-lens-array for millimeter-wave applications," IEEE 2004 AP-S Int. Symp. Dig., Monterey, CA, Jun. 2004.
Grajek et al., "A 24-GHz High-Gain Yagi-Uda Antenna Array," IEEE Transactions on Antennas and Propagation, May 2004, pp. 1257-1261.
Schoenlinner, B., "Compact Wide Scan Angle Antennas for Automotive Applications and RF MEMS Switchable Frequency Selective Surfaces", Ph.D. Dissertation, University of Michigan, Feb. 2004.
Office Action in U.S. Appl. No. 10/907,305, Mailed on Jul. 25, 2006.
PCT/US05/10596 International Search Report and Written Opinion of the International Searching Authority, Dec. 6, 2006, 10 pages.
Office Action in U.S. Appl. No. 11/931,625, Mailed on Feb. 13, 2009, Search information and Examiner's search strategy and results, 12 pp.

* cited by examiner

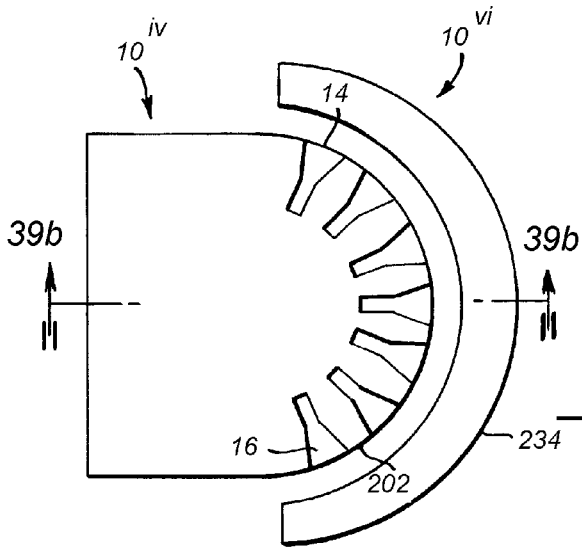
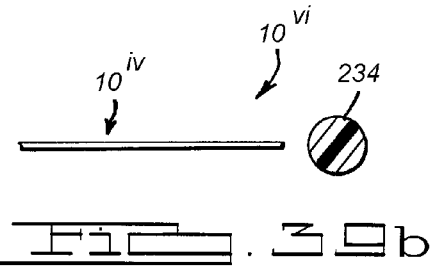
FIG. 39b
FIG. 39a.
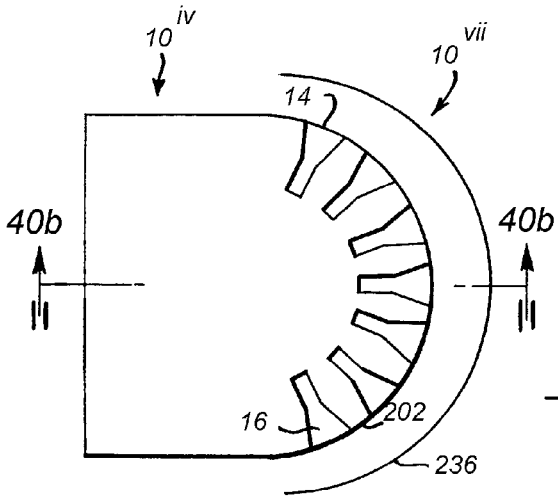
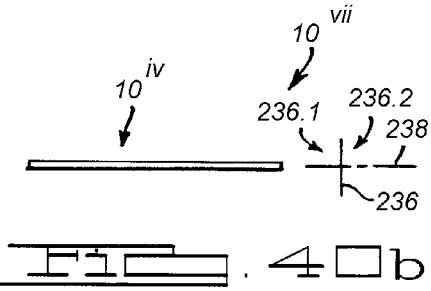
FIG. 40b
FIG. 40a.

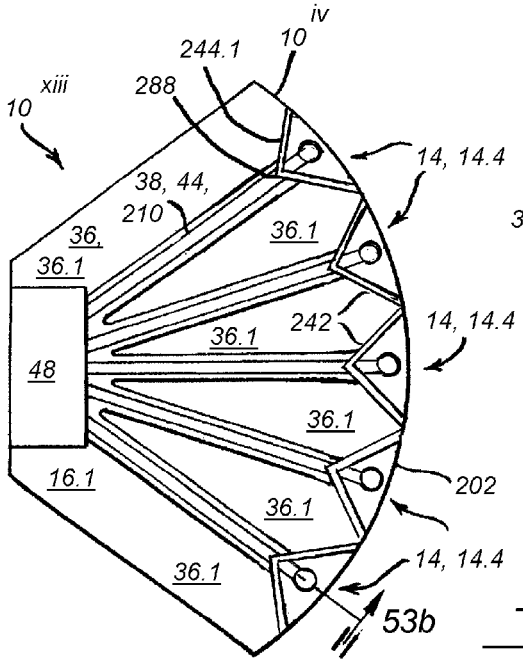
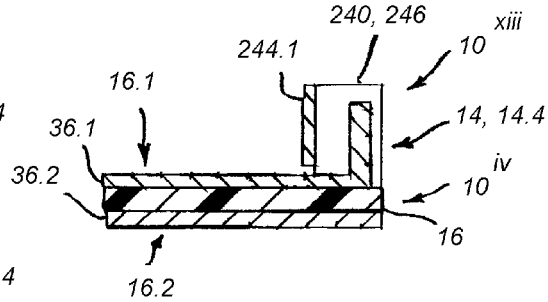
FIG. 53b.
FIG. 53a.
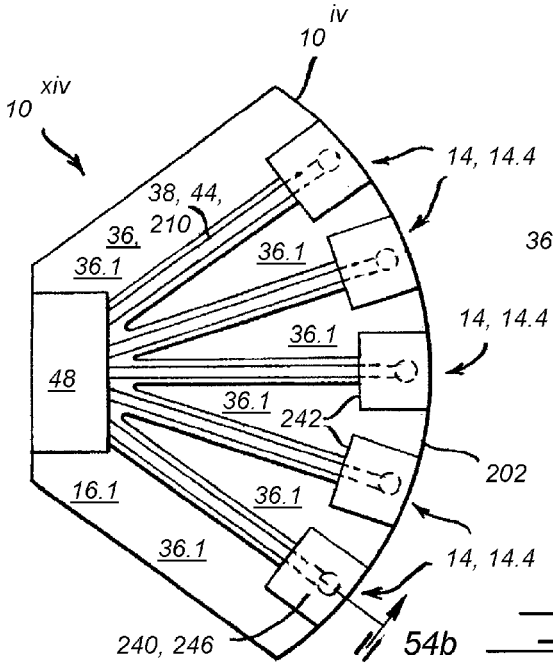
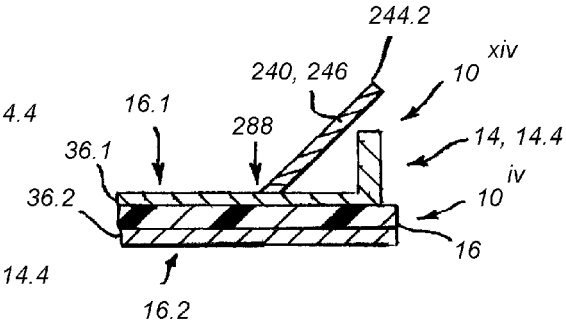
FIG. 54b.
FIG. 54a.

MULTI-BEAM ANTENNA

CROSS-REFERENCE TO RELATED APPLICATIONS

The instant application is a continuation-in-part of U.S. application Ser. No. 10/907,305, filed on Mar. 28, 2005, now abandoned, which claims the benefit of prior U.S. Provisional Application Ser. No. 60/521,284 filed on Mar. 26, 2004, and of prior U.S. Provisional Application Ser. No. 60/522,077 filed on Aug. 11, 2004. The instant application is also a continuation-in-part of U.S. application Ser. No. 11/161,681, filed on Aug. 11, 2005, which claims the benefit of prior U.S. Provisional Application Ser. No. 60/522,077 filed on Aug. 11, 2004, and which is a continuation-in-part of U.S. application Ser. No. 10/604,716, filed on Aug. 12, 2003, now U.S. Pat. No. 7,042,420, which is a continuation-in-part of U.S. application Ser. No. 10/202,242, filed on Jul. 23, 2002, now U.S. Pat. No. 6,606,077, which is a continuation-in-part of U.S. application Ser. No. 09/716,736, filed on Nov. 20, 2000, now U.S. Pat. No. 6,424,319, which claims the benefit of U.S. Provisional Application Ser. No. 60/166,231 filed on Nov. 18, 1999. The instant application incorporates matter from U.S. application Ser. No. 11/382,011, filed on May 5, 2006, which claims the benefit of prior U.S. Provisional Application Ser. No. 60/594,783 filed on May 5, 2005. All of the above-identified applications are incorporated herein by reference in their entirety.

BRIEF DESCRIPTION OF THE DRAWINGS

In the accompanying drawings:

FIG. 39*a* illustrates a top plan view of an embodiment of a seventh aspect of a multi-beam antenna incorporating a conformal cylindrical dielectric lens;

FIG. 39*b* illustrates a cross-sectional view of the embodiment of the multi-beam antenna illustrated in FIG. 39*a* incorporating a circular cylindrical lens;

FIG. 40*a* illustrates a top plan view of an embodiment of an eighth aspect of a multi-beam antenna incorporating a discrete lens array;

FIG. 40*b* illustrates a cross-sectional view of the embodiment of the multi-beam antenna illustrated in FIG. 40*a* incorporating a discrete lens array;

FIGS. 53*a* and 53*b* illustrate an embodiment of a fourteenth aspect of a multi-beam antenna incorporating a plurality of monopole antennas with associated corner reflectors;

FIGS. 54*a* and 54*b* illustrate an embodiment of a fifteenth aspect of a multi-beam antenna incorporating a plurality of monopole antennas with associated corner reflectors;

DETAILED DESCRIPTION OF EMBODIMENT(S)

Figure 1:
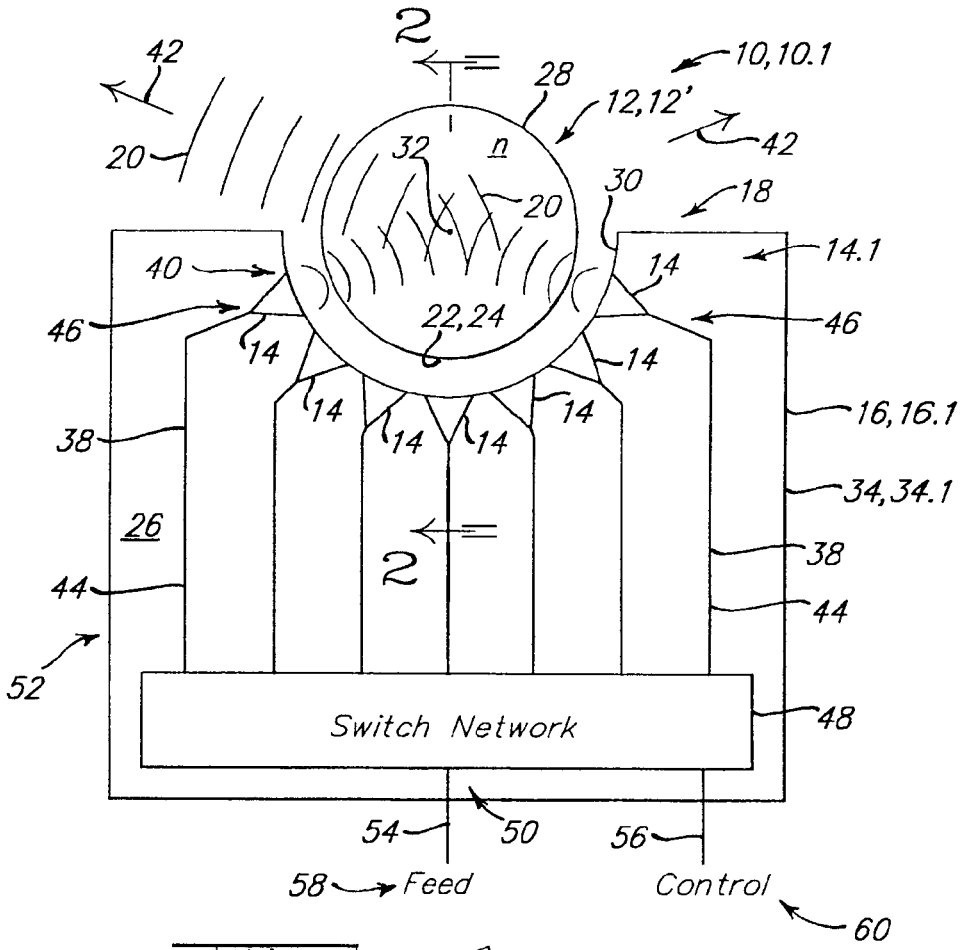
FIG. 1 illustrates a top view of a first embodiment of a multi-beam antenna comprising an electromagnetic lens.
Figure 2:
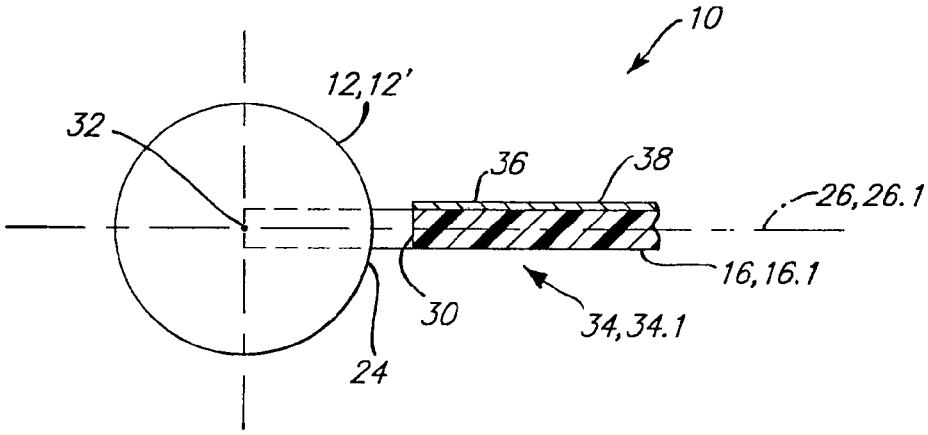
FIG. 2 illustrates a fragmentary side cross-sectional view of the embodiment illustrated in FIG. 1.

Referring to FIGS. 1 and 2, a multi-beam antenna 10, 10.1 comprises at least one electromagnetic lens 12 and a plurality of antenna feed elements 14 on a dielectric substrate 16 proximate to a first edge 18 thereof, wherein the plurality of antenna feed elements 14 are adapted to radiate or receive a corresponding plurality of beams of electromagnetic energy 20 through the at least one electromagnetic lens 12.

Figure 3:
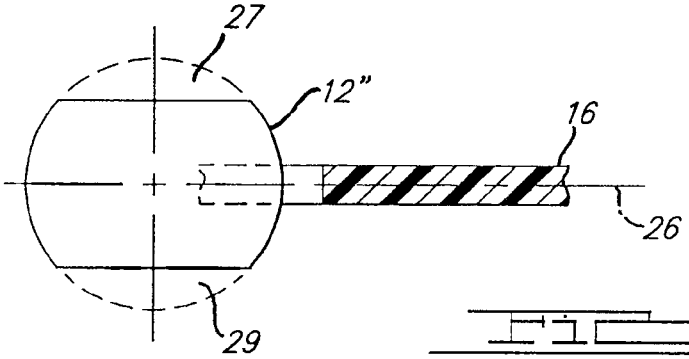
FIG. 3 illustrates a fragmentary side cross-sectional view of the embodiment illustrated in FIG. 1, incorporating a truncated electromagnetic lens.

The at least one electromagnetic lens 12 has a first side 22 having a first contour 24 at an intersection of the first side 22 with a reference surface 26, for example, a plane 26.1. The at least one electromagnetic lens 12 acts to diffract the electromagnetic wave from the respective antenna feed elements 14, wherein different antenna feed elements 14 at different locations and in different directions relative to the at least one electromagnetic lens 12 generate different associated different beams of electromagnetic energy 20. The at least one electromagnetic lens 12 has a refractive index n different from free space, for example, a refractive index n greater than one (1). For example, the at least one electromagnetic lens 12 may be constructed of a material such as REXOLITE™, TEFLON™, polyethylene, polystyrene or some other dielectric; or a plurality of different materials having different refractive indices, for example as in a Luneburg lens. In accordance with known principles of diffraction, the shape and size of the at least one electromagnetic lens 12, the refractive index n thereof, and the relative position of the antenna feed elements 14 to the electromagnetic lens 12 are adapted in accordance with the radiation patterns of the antenna feed elements 14 to provide a desired pattern of radiation of the respective beams of electromagnetic energy 20 exiting the second side 28 of the at least one electromagnetic lens 12. Whereas the at least one electromagnetic lens 12 is illustrated as a spherical lens 12' in FIGS. 1 and 2, the at least one electromagnetic lens 12 is not limited to any one particular design, and may, for example, comprise either a spherical lens, a Luneburg lens, a spherical shell lens, a hemispherical lens, an at least partially spherical lens, an at least partially spherical shell lens, an elliptical lens, a cylindrical lens, or a rotational lens. Moreover, one or more portions of the electromagnetic lens 12 may be truncated for improved packaging, without significantly impacting the performance of the associated multi-beam antenna 10, 10.1. For example, FIG. 3 illustrates an at least partially spherical electromagnetic lens 12" with opposing first 27 and second 29 portions removed therefrom.

Figure 4:
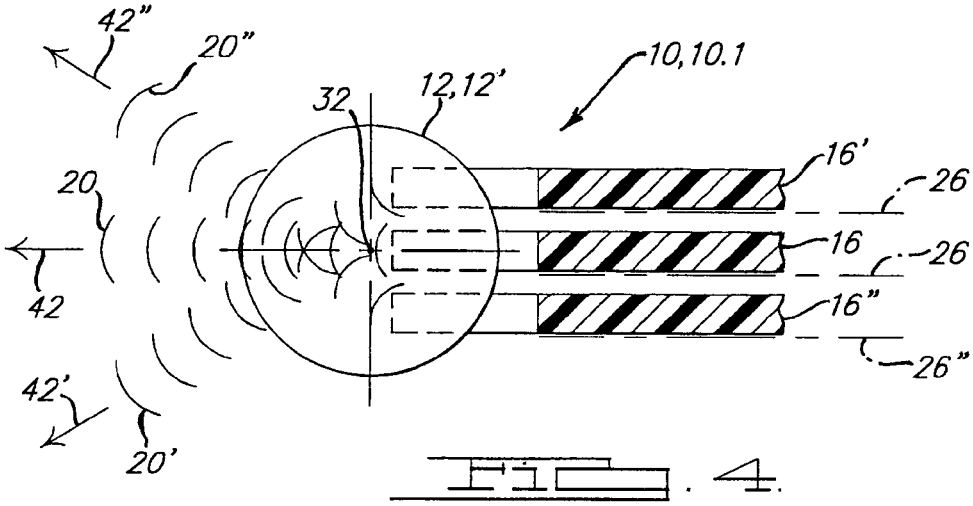
FIG. 4 illustrates a fragmentary side cross-sectional view of an embodiment illustrating various locations of a dielectric substrate, relative to an electromagnetic lens.

The first edge 18 of the dielectric substrate 16 comprises a second contour 30 that is proximate to the first contour 24. The first edge 18 of the dielectric substrate 16 is located on the reference surface 26, and is positioned proximate to the first side 22 of one of the at least one electromagnetic lens 12. The dielectric substrate 16 is located relative to the electromagnetic lens 12 so as to provide for the diffraction by the at least one electromagnetic lens 12 necessary to form the beams of electromagnetic energy 20. For the example of a multi-beam antenna 10 comprising a planar dielectric substrate 16 located on reference surface 26 comprising a plane 26.1, in combination with an electromagnetic lens 12 having a center 32, for example, a spherical lens 12'; the plane 26.1 may be located substantially close to the center 32 of the electromagnetic lens 12 so as to provide for diffraction by at least a portion of the electromagnetic lens 12. Referring to FIG. 4, the dielectric substrate 16 may also be displaced relative to the center 32 of the electromagnetic lens 12, for example on one or the other side of the center 32 as illustrated by dielectric substrates 16' and 16", which are located on respective reference surfaces 26' and 26".

The dielectric substrate 16 is, for example, a material with low loss at an operating frequency, for example, DUROID™, a TEFLON™ containing material, a ceramic material, or a composite material such as an epoxy/fiberglass composite. Moreover, in one embodiment, the dielectric substrate 16 comprises a dielectric 16.1 of a circuit board 34, for example, a printed circuit board 34.1 comprising at least one conductive layer 36 adhered to the dielectric substrate 16, from which the antenna feed elements 14 and other associated circuit traces 38 are formed, for example, by subtractive technology, for example, chemical or ion etching, or stamping; or additive techniques, for example, deposition, bonding or lamination.

The plurality of antenna feed elements 14 are located on the dielectric substrate 16 along the second contour 30 of the first edge 18, wherein each antenna feed element 14 comprises a least one conductor 40 operatively connected to the dielectric substrate 16. For example, at least one of the antenna feed elements 14 comprises an end-fire antenna element 14.1 adapted to launch or receive electromagnetic waves in a direction 42 substantially towards or from the first side 22 of the at least one electromagnetic lens 12, wherein different end-fire antenna elements 14.1 are located at different locations along the second contour 30 so as to launch or receive respective electromagnetic waves in different directions 42. An end-fire antenna element 14.1 may, for example, comprise either a Yagi-Uda antenna, a coplanar horn antenna (also known as a tapered slot antenna), a Vivaldi antenna, a tapered dielectric rod, a slot antenna, a dipole antenna, or a helical antenna, each of which is capable of being formed on the dielectric substrate 16, for example, from a printed circuit board 34.1, for example, by subtractive technology, for example, chemical or ion etching, or stamping; or additive techniques, for example, deposition, bonding or lamination. Moreover, the antenna feed elements 14 may be used for transmitting, receiving or both transmitting and receiving.

Referring to FIG. 4, the direction 42 of the one or more beams of electromagnetic energy 20, 20', 20" through the electromagnetic lens 12, 12' is responsive to the relative location of the dielectric substrate 16, 16' or 16" and the associated reference surface 26, 26' or 26" relative to the center 32 of the electromagnetic lens 12. For example, with the dielectric substrate 16 substantially aligned with the center 32, the directions 42 of the one or more beams of electromagnetic energy 20 are nominally aligned with the reference surface 26. Alternately, with the dielectric substrate 16' above the center 32 of the electromagnetic lens 12, 12', the resulting one or more beams of electromagnetic energy 20' propagate in directions 42' below the center 32. Similarly, with the dielectric substrate 16" below the center 32 of the electromagnetic lens 12, 12', the resulting one or more beams of electromagnetic energy 20" propagate in directions 42" above the center 32.

The multi-beam antenna 10 may further comprise at least one transmission line 44 on the dielectric substrate 16 operatively connected to a feed port 46 of one of the plurality of antenna feed elements 14, for feeding a signal to the associated antenna feed element 14. For example, the at least one transmission line 44 may comprise either a stripline, a microstrip line, an inverted microstrip line, a slotline, an image line, an insulated image line, a tapped image line, a coplanar stripline, or a coplanar waveguide line formed on the dielectric substrate 16, for example, from a printed circuit board 34.1, for example, by subtractive technology, for example, chemical or ion etching, or stamping; or additive techniques, for example, deposition, bonding or lamination.

The multi-beam antenna 10 may further comprise a switching network 48 having at least one input 50 and a plurality of outputs 52, wherein the at least one input 50 is operatively connected—for example, via at least one above described transmission line 44—to a corporate antenna feed port 54, and each output 52 of the plurality of outputs 52 is connected—for example, via at least one above described transmission line 44—to a respective feed port 46 of a different antenna feed element 14 of the plurality of antenna feed elements 14. The switching network 48 further comprises at least one control port 56 for controlling which outputs 52 are connected to the at least one input 50 at a given time. The switching network 48 may, for example, comprise either a plurality of micro-mechanical switches, PIN diode switches, transistor switches, or a combination thereof, and may, for example, be operatively connected to the dielectric substrate 16, for example, by surface mount to an associated conductive layer 36 of a printed circuit board 34.1.

In operation, a feed signal 58 applied to the corporate antenna feed port 54 is either blocked—for example, by an open circuit, by reflection or by absorption,—or switched to the associated feed port 46 of one or more antenna feed elements 14, via one or more associated transmission lines 44, by the switching network 48, responsive to a control signal 60 applied to the control port 56. It should be understood that the feed signal 58 may either comprise a single signal common to each antenna feed element 14, or a plurality of signals associated with different antenna feed elements 14. Each antenna feed element 14 to which the feed signal 58 is applied launches an associated electromagnetic wave into the first side 22 of the associated electromagnetic lens 12, which is diffracted thereby to form an associated beam of electromagnetic energy 20. The associated beams of electromagnetic energy 20 launched by different antenna feed elements 14 propagate in different associated directions 42. The various beams of electromagnetic energy 20 may be generated individually at different times so as to provide for a scanned beam of electromagnetic energy 20. Alternately, two or more beams of electromagnetic energy 20 may be generated simultaneously. Moreover, different antenna feed elements 14 may be driven by different frequencies that, for example, are either directly switched to the respective antenna feed elements 14, or switched via an associated switching network 48 having a plurality of inputs 50, at least some of which are connected to different feed signals 58.

Figure 5:
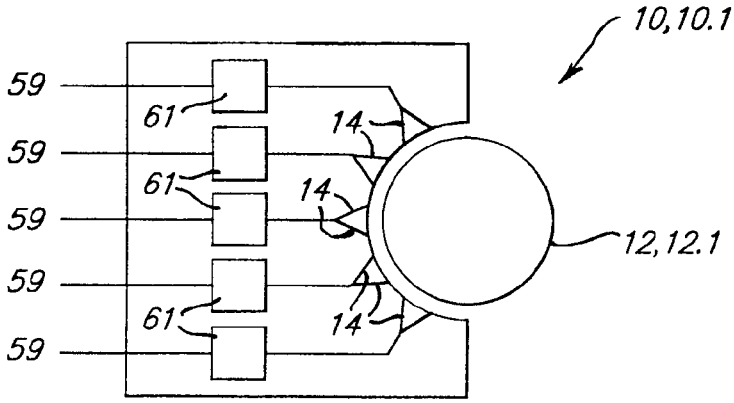
FIG. 5 illustrates an embodiment of a multi-beam antenna, wherein each antenna feed element is operatively coupled to a separate signal.

Referring to FIG. 5, the multi-beam antenna 10, 10.1 may be adapted so that the respective signals are associated with the respective antenna feed elements 14 in a one-to-one relationship, thereby precluding the need for an associated switching network 48. For example, each antenna feed element 14 can be operatively connected to an associated signal 59 through an associated processing element 61. As one example, with the multi-beam antenna 10, 10.1 configured as an imaging array, the respective antenna feed elements 14 are used to receive electromagnetic energy, and the respective processing elements 61 comprise detectors. As another example, with the multi-beam antenna 10, 10.1 configured as a communication antenna, the respective antenna feed elements 14 are used to both transmit and receive electromagnetic energy, and the respective processing elements 61 comprise transmit/receive modules or transceivers.

Figure 6:
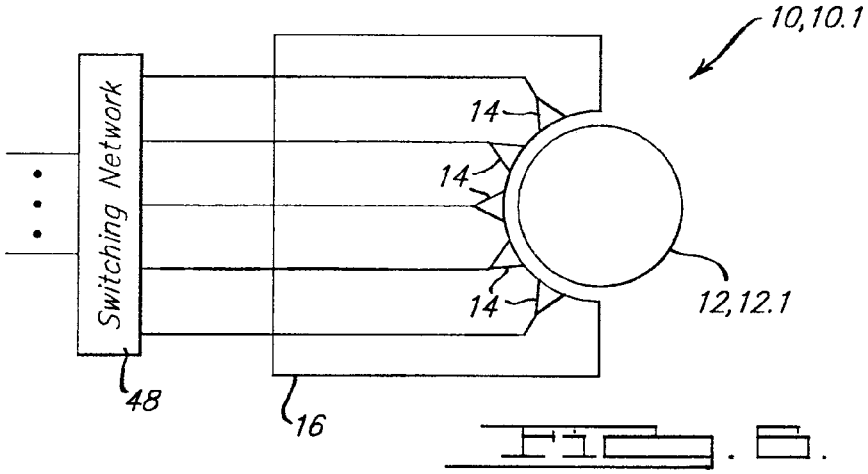
FIG. 6 illustrates an embodiment of a multi-beam antenna, wherein the associated switching network is located separately from the dielectric substrate.

Referring to FIG. 6, the switching network 48, if used, need not be collocated on a common dielectric substrate 16, but can be separately located, as, for example, may be useful for low frequency applications, for example, for operating frequencies less than 20 GHz, e.g. 1-20 GHz.

Figure 7:
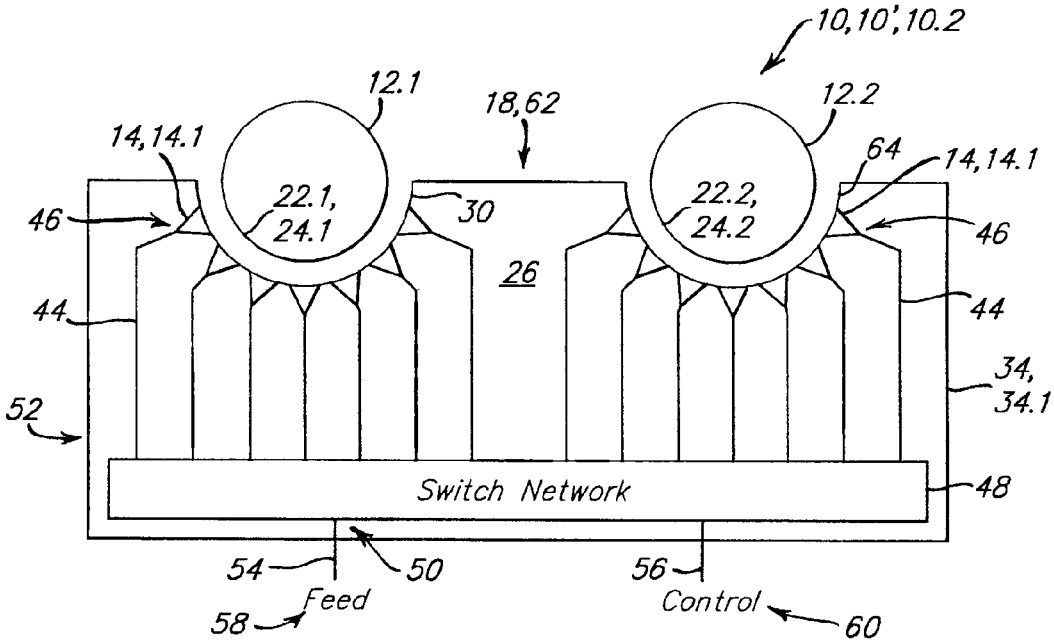
FIG. 7 illustrates a top view of a second embodiment of a multi-beam antenna comprising a plurality of electromagnetic lenses located proximate to one edge of a dielectric substrate.
Figure 8:
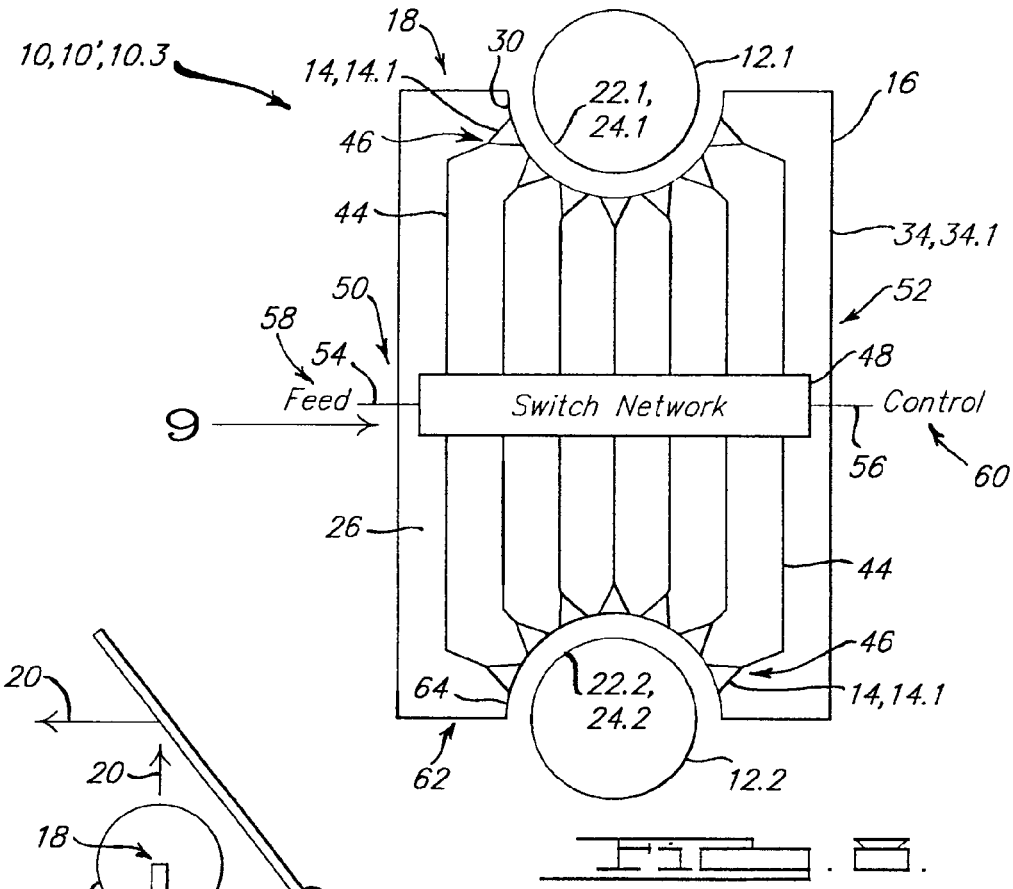
FIG. 8 illustrates a top view of a third embodiment of a multi-beam antenna comprising a plurality of electromagnetic lenses located proximate to opposite edges of a dielectric substrate.
Figure 9:
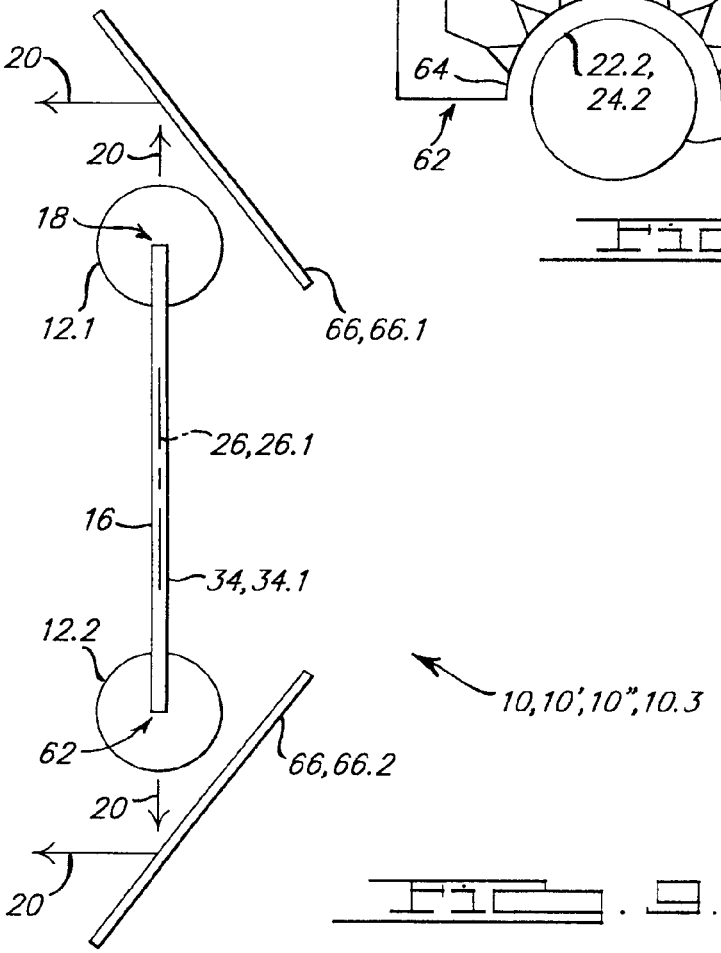
FIG. 9 illustrates a side view of the third embodiment illustrated in FIG. 8, further comprising a plurality of reflectors.

Referring to FIGS. 7, 8 and 9, in accordance with a second aspect, a multi-beam antenna 10' comprises at least first 12.1 and second 12.2 electromagnetic lenses, each having a first side 22.1, 22.2 with a corresponding first contour 24.1, 24.2 at an intersection of the respective first side 22.1, 22.2 with the reference surface 26. The dielectric substrate 16 comprises at least a second edge 62 comprising a third contour 64, wherein the second contour 30 is proximate to the first contour 24.1 of the first electromagnetic lens 12.1 and the third contour 64 is proximate to the first contour 24.2 of the second electromagnetic lens 12.2.

Referring to FIG. 7, in accordance with a second embodiment of the multi-beam antenna 10.2, the second edge 62 is the same as the first edge 18 and the second 30 and third 64 contours are displaced from one another along the first edge 18 of the dielectric substrate 16.

Referring to FIG. 8, in accordance with a third embodiment of the multi-beam antenna 10.3, the second edge 62 is different from the first edge 18, and more particularly is opposite to the first edge 18 of the dielectric substrate 16.

Referring to FIG. 9, in accordance with a third aspect, a multi-beam antenna 10" comprises at least one reflector 66, wherein the reference surface 26 intersects the at least one reflector 66 and one of the at least one electromagnetic lens 12 is located between the dielectric substrate 16 and the reflector 66. The at least one reflector 66 is adapted to reflect electromagnetic energy propagated through the at least one electromagnetic lens 12 after being generated by at least one of the plurality of antenna feed elements 14. The third embodiment of the multi-beam antenna 10 comprises at least first 66.1 and second 66.2 reflectors wherein the first electromagnetic lens 12.1 is located between the dielectric substrate 16 and the first reflector 66.1, the second electromagnetic lens 12.2 is located between the dielectric substrate 16 and the second reflector 66.2, the first reflector 66.1 is adapted to reflect electromagnetic energy propagated through the first electromagnetic lens 12.1 after being generated by at least one of the plurality of antenna feed elements 14 on the second contour 30, and the second reflector 66.2 is adapted to reflect electromagnetic energy propagated through the second electromagnetic lens 12.2 after being generated by at least one of the plurality of antenna feed elements 14 on the third contour 64. For example, the first 66.1 and second 66.2 reflectors may be oriented to direct the beams of electromagnetic energy 20 from each side in a common nominal direction, as illustrated in FIG. 9. Referring to FIG. 9, the multi-beam antenna 10" as illustrated would provide for scanning in a direction normal to the plane of the illustration. If the dielectric substrate 16 were rotated by 90 degrees with respect to the reflectors 66.1, 66.2, about an axis connecting the respective electromagnetic lenses 12.1, 12.1, then the multi-beam antenna 10" would provide for scanning in a direction parallel to the plane of the illustration.

Figure 10:
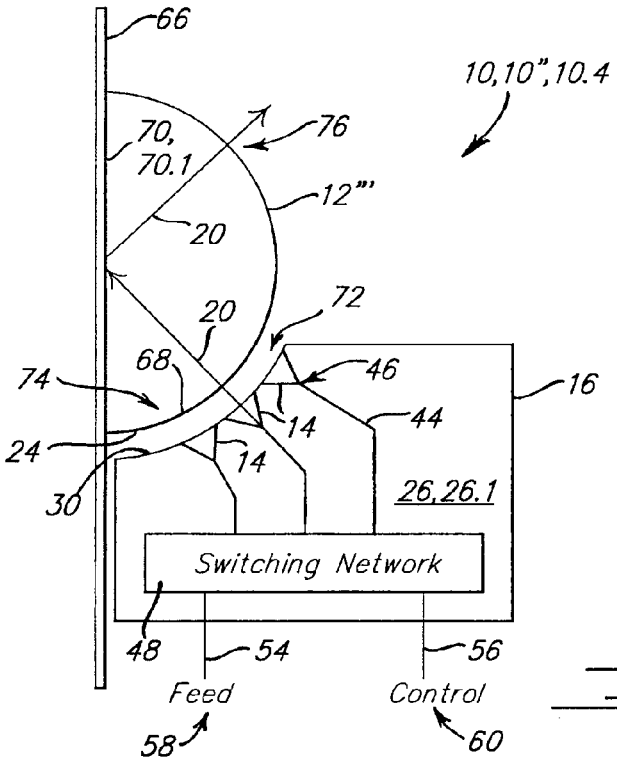
FIG. 10 illustrates a fourth embodiment of a multi-beam antenna, comprising an electromagnetic lens and a reflector.

Referring to FIG. 10, in accordance with the third aspect and a fourth embodiment, a multi-beam antenna 10", 10.4 comprises an at least partially spherical electromagnetic lens 12''', for example, a hemispherical electromagnetic lens, having a curved surface 68 and a boundary 70, for example a flat boundary 70.1. The multi-beam antenna 10", 10.4 further comprises a reflector 66 proximate to the boundary 70, and a plurality of antenna feed elements 14 on a dielectric substrate 16 proximate to a contoured edge 72 thereof, wherein each of the antenna feed elements 14 is adapted to radiate a respective plurality of beams of electromagnetic energy 20 into a first sector 74 of the electromagnetic lens 12'''. The electromagnetic lens 12''' has a first contour 24 at an intersection of the first sector 74 with a reference surface 26, for example, a plane 26.1. The contoured edge 72 has a second contour 30 located on the reference surface 26 that is proximate to the first contour 24 of the first sector 74. The multi-beam antenna 10", 10.4 further comprises a switching network 48 and a plurality of transmission lines 44 operatively connected to the antenna feed elements 14 as described hereinabove for the other embodiments.

In operation, at least one feed signal 58 applied to a corporate antenna feed port 54 is either blocked, or switched to the associated feed port 46 of one or more antenna feed elements 14, via one or more associated transmission lines 44, by the switching network 48 responsive to a control signal 60 applied to a control port 56 of the switching network 48. Each antenna feed element 14 to which the feed signal 58 is applied launches an associated electromagnetic wave into the first sector 74 of the associated electromagnetic lens 12'''. The electromagnetic wave propagates through—and is diffracted by—the curved surface 68, and is then reflected by the reflector 66 proximate to the boundary 70, whereafter the reflected electromagnetic wave propagates through the electromagnetic lens 12''' and exits—and is diffracted by—a second sector 76 as an associated beam of electromagnetic energy 20. With the reflector 66 substantially normal to the reference surface 26—as illustrated in FIG. 10—the different beams of electromagnetic energy 20 are directed by the associated antenna feed elements 14 in different directions that are nominally substantially parallel to the reference surface 26.

Figure 11:
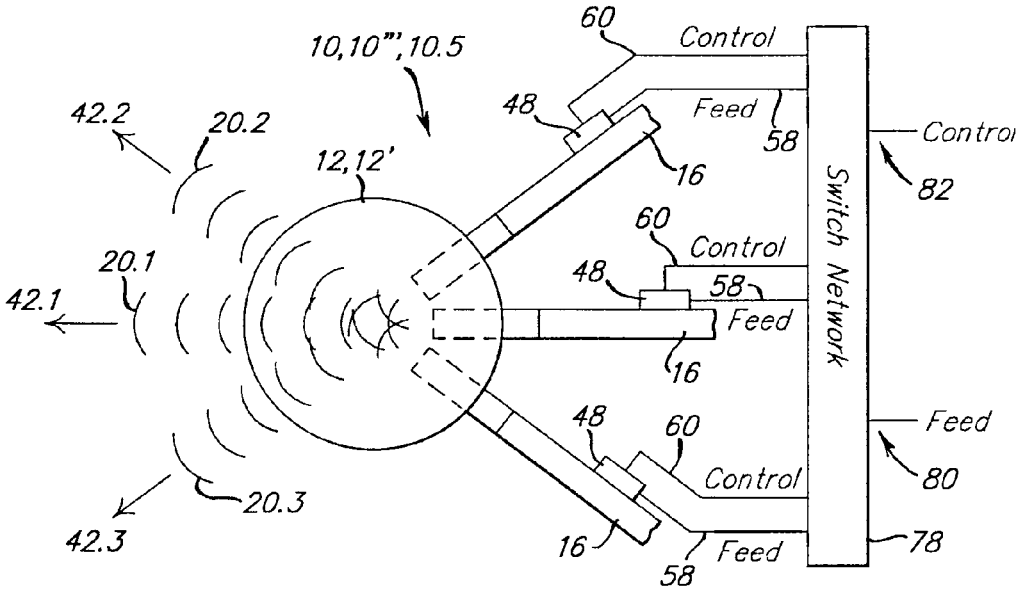
FIG. 11 illustrates a fifth embodiment of a multi-beam antenna.

Referring to FIG. 11, in accordance with a fourth aspect and a fifth embodiment, a multi-beam antenna 10''', 10.5 comprises an electromagnetic lens 12 and plurality of dielectric substrates 16, each comprising a set of antenna feed elements 14 and operating in accordance with the description hereinabove. Each set of antenna feed elements 14 generates (or is capable of generating) an associated set of beams of electromagnetic energy 20.1, 20.2 and 20.3, each having associated directions 42.1, 42.2 and 42.3, responsive to the associated feed 58 and control 60 signals. The associated feed 58 and control 60 signals are either directly applied to the associated switch network 48 of the respective sets of antenna feed elements 14, or are applied thereto through a second switch network 78 having associated feed 80 and control 82 ports, each comprising at least one associated signal. Accordingly, the multi-beam antenna 10''', 10.5 provides for transmitting or receiving one or more beams of electromagnetic energy over a three-dimensional space.

The multi-beam antenna 10 provides for a relatively wide field-of-view, and is suitable for a variety of applications, including but not limited to automotive radar, point-to-point communications systems and point-to-multi-point communication systems, over a wide range of frequencies for which the antenna feed elements 14 may be designed to radiate, for example, frequencies in the range of 1 to 200 GHz. Moreover, the multi-beam antenna 10 may be configured for either mono-static or bi-static operation.

When relatively a narrow beamwidth, i.e. a high gain, is desired at a relatively lower frequency, a dielectric electromagnetic lens 12 can become relatively large and heavy. Generally, for these and other operating frequencies, the dielectric electromagnetic lens 12 may be replaced with a discrete lens array 100, e.g. a planar lens 100.1, which can beneficially provide for setting the polarization, the ratio of focal length to diameter, and the focal surface shape, and can be more readily be made to conform to a surface. A discrete lens array 100 can also be adapted to incorporate amplitude weighting so as to provide for control of sidelobes in the associates beams of electromagnetic energy 20.

Figure 12:
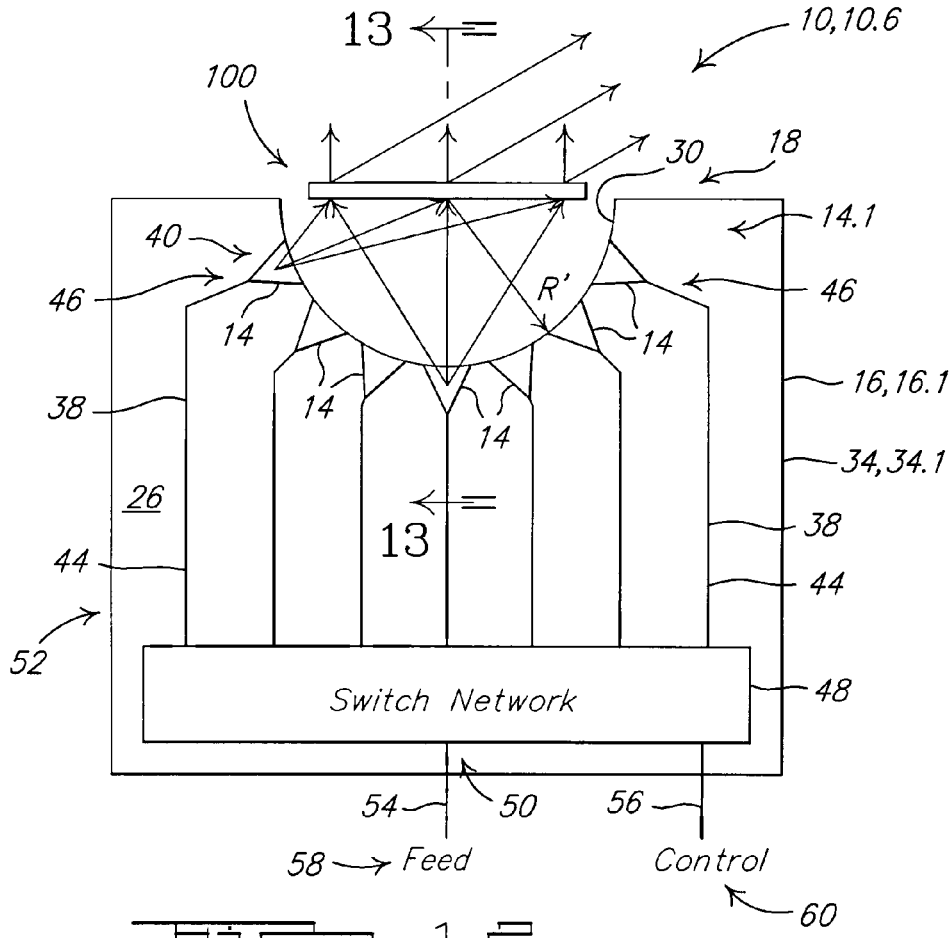
FIG. 12 illustrates a top view of a sixth embodiment of a multi-beam antenna comprising a discrete lens array.
Figure 13:
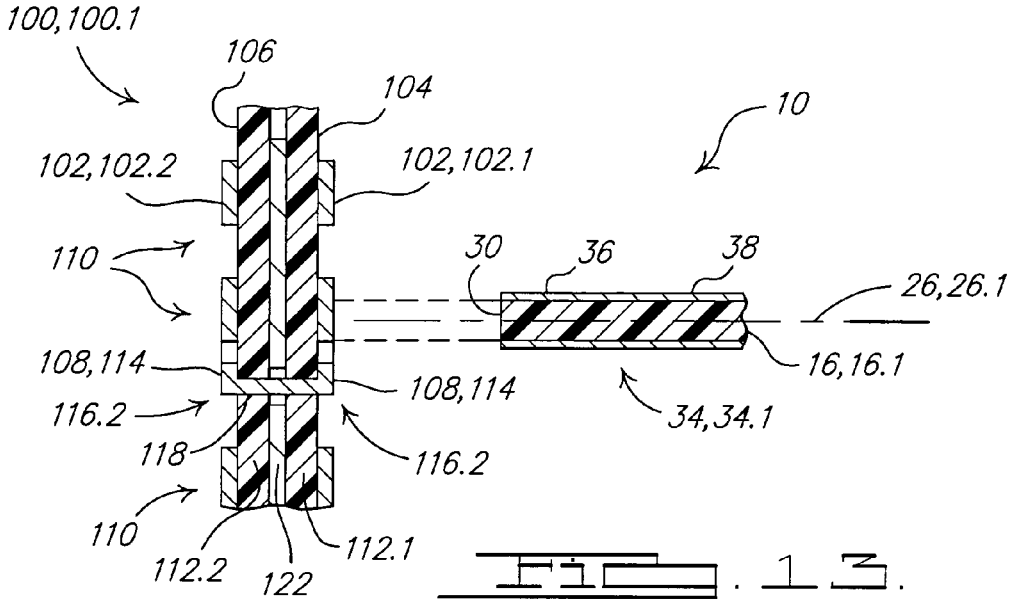
FIG. 13 illustrates a fragmentary side cross-sectional view of the embodiment illustrated in FIG. 12.
Figure 14:
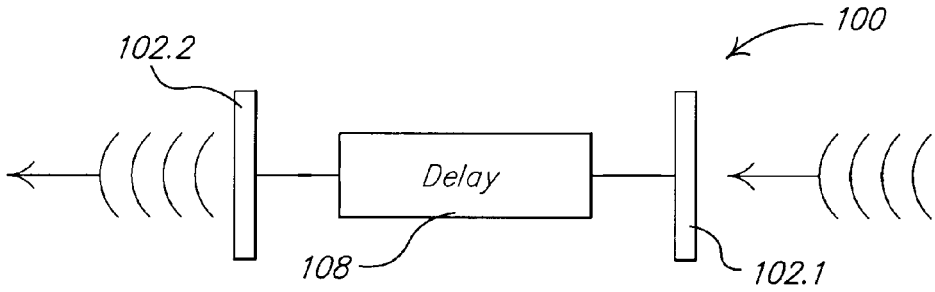
FIG. 14 illustrates a block diagram of a lens element of a discrete lens array.

For example, referring to FIGS. 12 and 13, in accordance with the first aspect and a sixth embodiment of a multi-beam antenna 10, 10.6, the dielectric electromagnetic lens 12 of the first embodiment of the multi-beam antenna 10, 10.1 illustrated in FIGS. 1 and 2 is replaced with a planar lens 100.1 comprising a first set of patch antennas 102.1 on a first side 104 of the planar lens 100.1, and a second set of patch antennas 102.2 on the second side 106 of the planar lens 100.1, where the first 104 and second 106 sides are opposite one another. The individual patch antennas 102 of the first 102.1 and second 102.2 sets of patch antennas are in one-to-one correspondence. Referring to FIG. 14, each patch antenna 102, 102.1 on the first side 104 of the planar lens 100.1 is operatively coupled via a delay element 108 to a corresponding patch antenna 102, 102.2 on the second side 106 of the planar lens 100.1, wherein the patch antenna 102, 102.1 on the first side 104 of the planar lens 100.1 is substantially aligned with the corresponding patch antenna 102, 102.2 on the second side 106 of the planar lens 100.1.

In operation, electromagnetic energy that is radiated upon one of the patch antennas 102, e.g. a first patch antenna 102.1 on the first side 104 of the planar lens 100.1, is received thereby, and a signal responsive thereto is coupled via—and delayed by—the delay element 108 to the corresponding patch antenna 102, e.g. the second patch antenna 102.2, wherein the amount of delay by the delay element 108 is dependent upon the location of the corresponding patch antennas 102 on the respective first 104 and second 106 sides of the planar lens 100.1. The signal coupled to the second patch antenna 102.2 is then radiated thereby from the second side 106 of the planar lens 100.1. Accordingly, the planar lens 100.1 comprises a plurality of lens elements 110, wherein each lens element 110 comprises a first patch antenna element 102.1 operatively coupled to a corresponding second patch antenna element 102.2 via at least one delay element 108, wherein the first 102.1 and second 102.2 patch antenna elements are substantially opposed to one another on opposite sides of the planar lens 100.1.

Figure 15A:
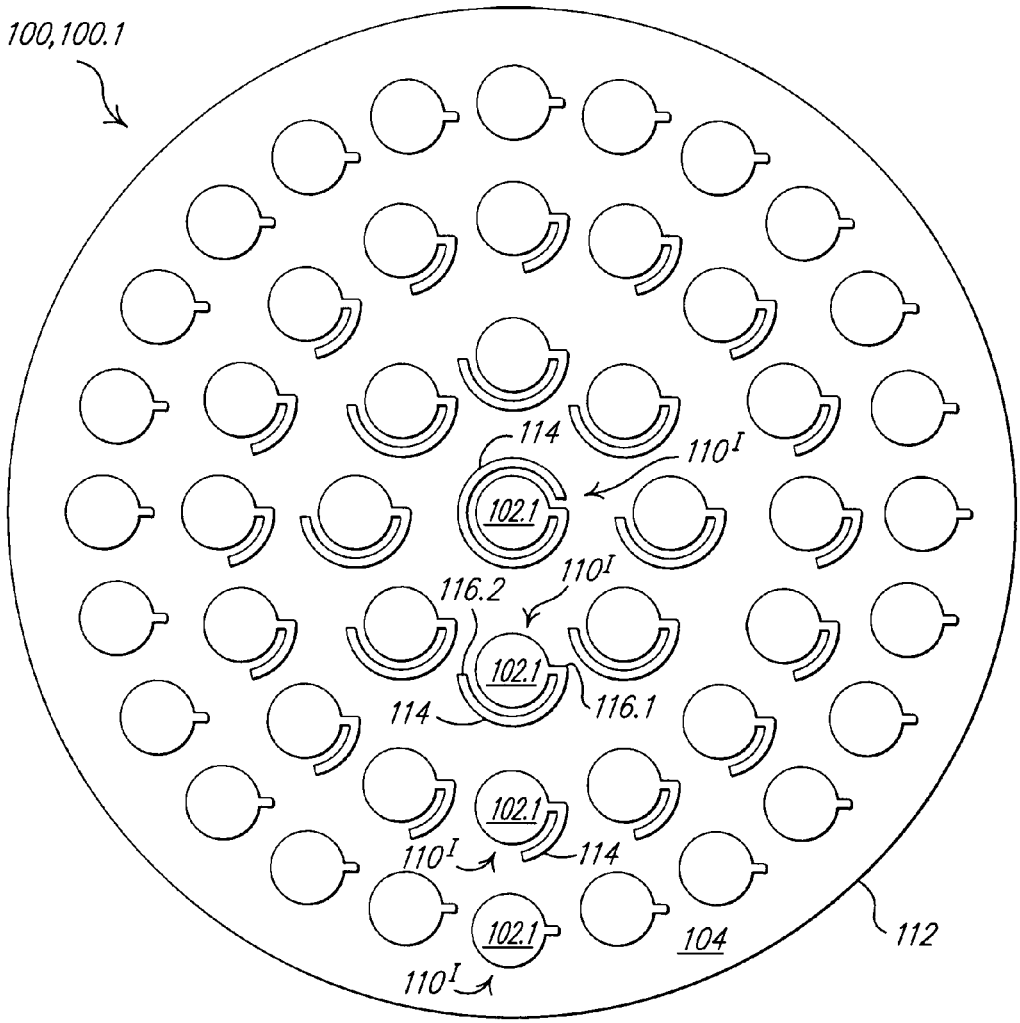
FIG. 15*a* illustrates a first side of one embodiment of a planar discrete lens array.
Figure 15B:
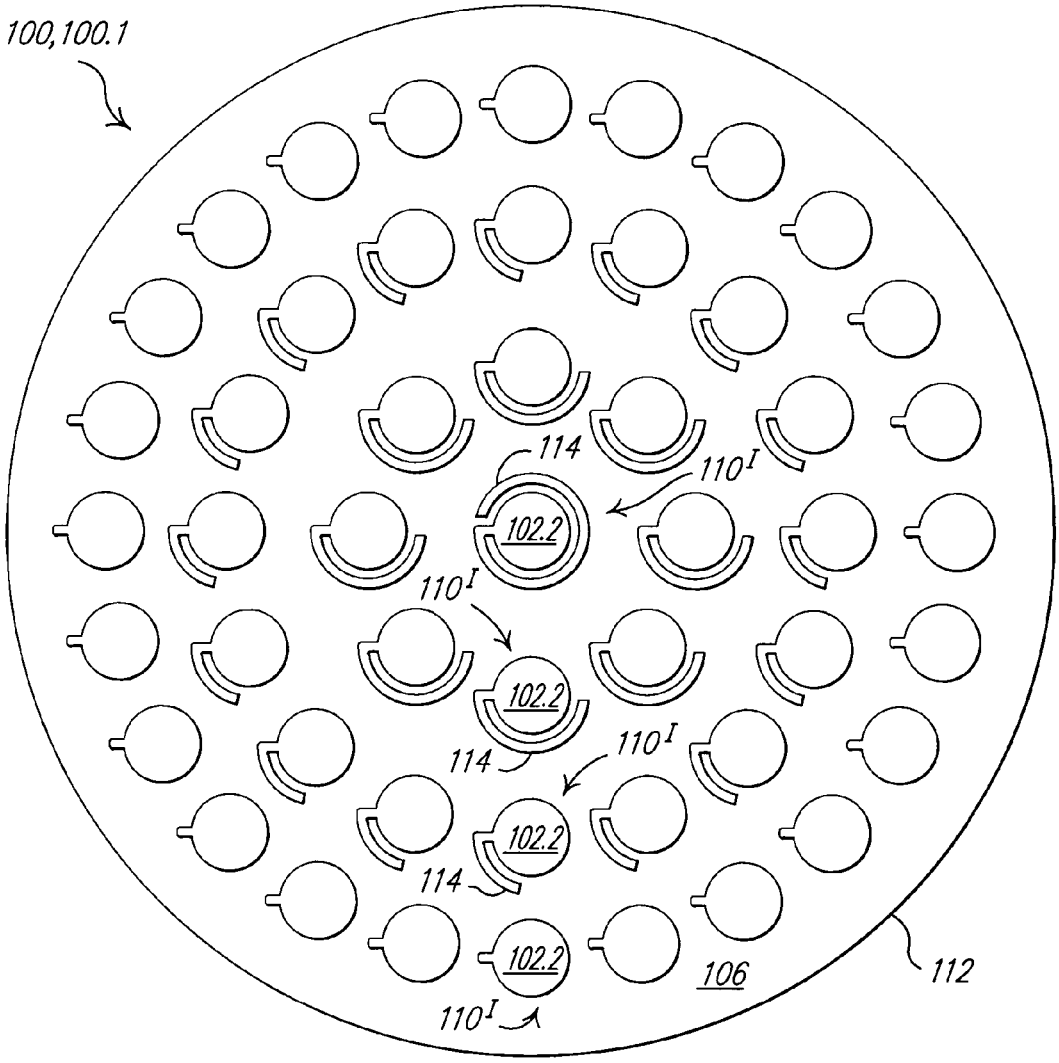
FIG. 15*b* illustrates a second side of the embodiment of the planar discrete lens array illustrated in FIG. 15*a;*

Referring also to FIGS. 15*a* and 15*b*, in a first embodiment of a planar lens 100.1, the patch antennas 102.1, 102.2 comprise conductive surfaces on a dielectric substrate 112, and the delay element 108 coupling the patch antennas 102.1, 102.2 of the first 104 and second 106 sides of the planar lens 100.1 comprise delay lines 114, e.g. microstrip or stipline structures, that are located adjacent to the associated patch antennas 102.1, 102.2 on the underlying dielectric substrate 112. The first ends 116.1 of the delay lines 114 are connected to the corresponding patch antennas 102.1, 102.2, and the second ends 116.2 of the delay lines 114 are interconnected to one another with a conductive path, for example, with a conductive via 118 though the dielectric substrate 112. FIGS. 15*a* and 15*b* illustrate the delay lines 114 arranged so as to provide for feeding the associated first 102.1 and second 102.2 sets of patch antennas at the same relative locations.

Figure 16:
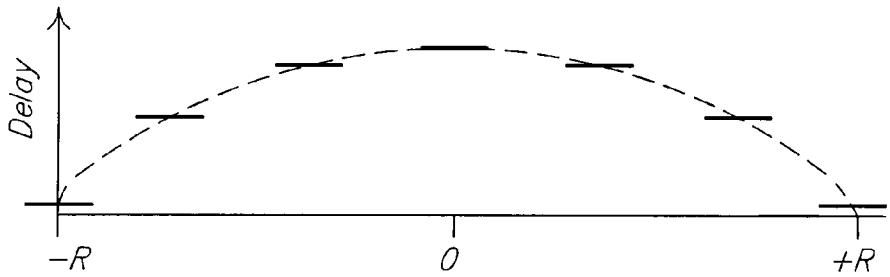
FIG. 16 illustrates a plot of delay as a function of radial location on the planar discrete lens array illustrated in FIGS. 15*a* and 15*b;*

Referring to FIG. 16, the amount of delay caused by the associated delay elements 108 is made dependent upon the location of the associated patch antenna 102 in the planar lens 100.1, and, for example, is set by the length of the associated delay lines 114, as illustrated by the configuration illustrated in FIGS. 15*a* and 15*b*, so as to emulate the phase properties of a convex electromagnetic lens 12, e.g. a spherical lens 12'. The shape of the delay profile illustrated in FIG. 16 can be of various configurations, for example, 1) uniform for all radial directions, thereby emulating a spherical lens 12'; 2) adapted to incorporate an azimuthal dependence, e.g. so as to emulate an elliptical lens; or 3) adapted to provide for focusing in one direction only, e.g. in the elevation plane of the multi-beam antenna 10.6, e.g. so as to emulate a cylindrical lens.

Figure 17:
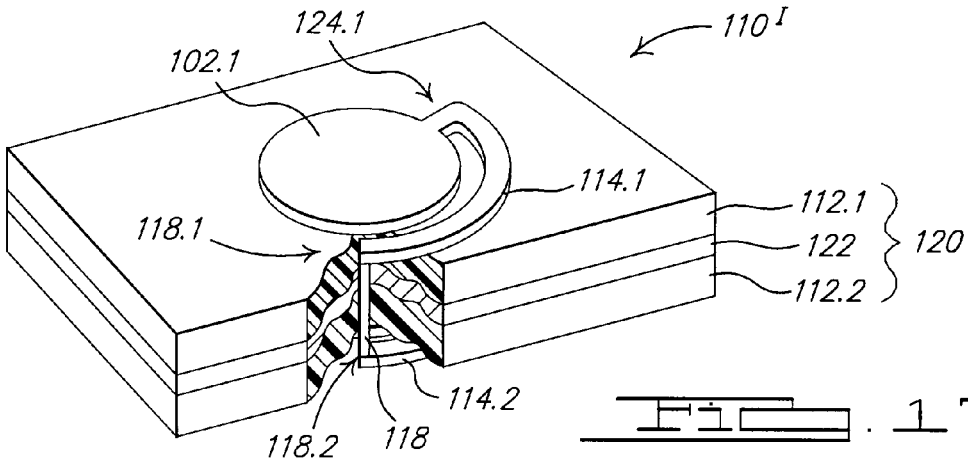
FIG. 17 illustrates a fragmentary cross sectional isometric view of a first embodiment of a discrete lens antenna element.
Figure 18:
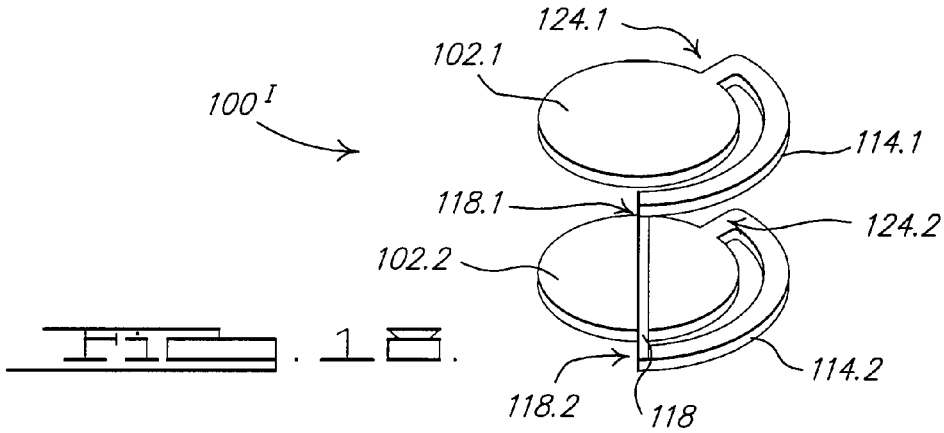
FIG. 18 illustrates an isometric view of the first embodiment of a discrete lens antenna element illustrated in FIG. 17, isolated from associated dielectric substrates.

Referring to FIGS. 17 and 18, a first embodiment of a lens element $\mathbf{110}^{I}$ of the planar lens 100.1 illustrated in FIGS. 15*a* and 15*b* comprises first 102.1 and second 102.2 patch antenna elements on the outer surfaces of a core assembly 120 comprising first 112.1 and second 112.2 dielectric substrates on both sides of a conductive ground plane 122 sandwiched therebetween. A first delay line 114.1 on the first side 104 of the planar lens 100.1 extends circumferentially from a first location 124.1 on the periphery of the first patch antenna element 102.1 to a first end 118.1 of a conductive via 118 extending through the core assembly 120, and a second delay line 114.2 on the second side 106 of the planar lens 100.1 extends circumferentially from a second location 124.2 on the periphery of the second patch antenna element 102.2 to a second end 118.2 of the conductive via 118. Accordingly, the combination of the first 114.1 and second 114.2 delay lines interconnected by the conductive via 118 constitutes the associated delay element 108 of the lens element 110, and the amount of delay of the delay element 108 is generally responsive to the cumulative circumferential lengths of the associated first 114.1 and second 114.2 delay lines and the conductive via 118.

Figure 19:
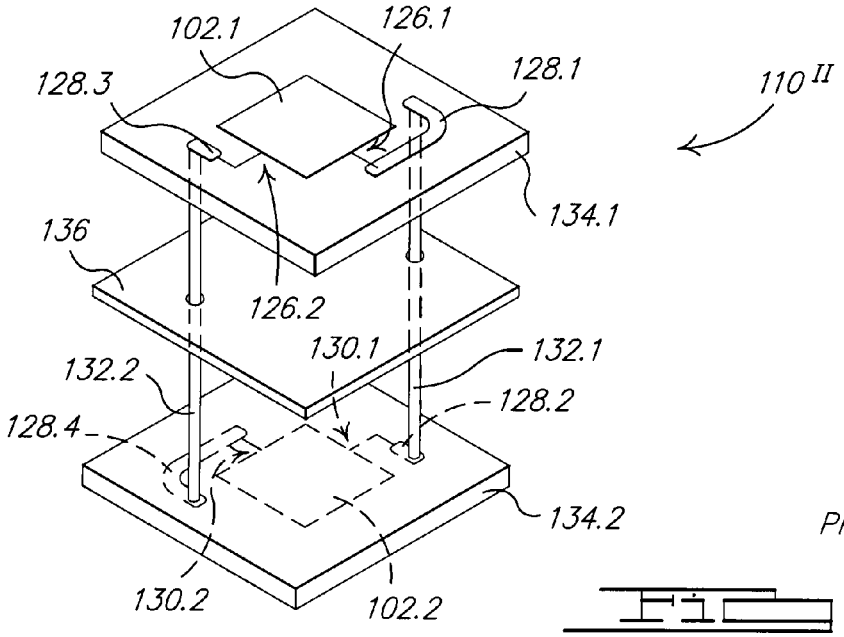
Prior Art FIG. 19
FIG. 19 illustrates an isometric view of a second embodiment of a discrete lens antenna element.

Referring to FIG. 19, in accordance with a second embodiment of a lens element $\mathbf{110}^{II}$ of the planar lens 100.1, the first 102.1 and second 102.2 patch antenna elements may be interconnected with one another so as to provide for dual polarization, for example, as disclosed in the technical paper "Multibeam Antennas with Polarization and Angle Diversity" by Darko Popovic and Zoya Popovic in *IEEE Transactions on Antenna and Propagation*, Vol. 50, No. 5, May 2002, which is incorporated herein by reference. A first location 126.1 on an edge of the first patch antenna element 102.1 is connected via first 128.1 and second 128.2 delay lines to a first location 130.1 on the second patch antenna element 102.2, and a second location 126.2 on an edge of the first patch antenna element 102.1 is connected via third 128.3 and fourth 128.4 delay lines to a second location 130.2 on the second patch antenna element 102.2, wherein, for example, the first 126.1 and second 126.2 locations on the first patch antenna element 102.1 are substantially orthogonal with respect to one another, as are the corresponding first 130.1 and second 130.2 locations on the second patch antenna element 102.2. The first 128.1 and second 128.2 delay lines are interconnected with a first conductive via 132.1 that extends through associated first 134.1 and second 134.2 dielectric substrates and through a conductive ground plane 136 located therebetween. Similarly, the third 128.3 and fourth 128.4 delay lines are interconnected with a second conductive via 132.2 that also extends through the associated first 134.1 and second 134.2 dielectric substrates and through the conductive ground plane 136. In the embodiment illustrated in FIG. 19, the first location 126.1 on the first patch antenna element 102.1 is shown substantially orthogonal to the first location 130.1 on the second patch antenna element 102.2 so that the polarization of the radiation from the second patch antenna element 102.2 is orthogonal with respect to that of the radiation incident upon the first patch antenna element 102.1. However, it should be understood that the first locations 126.1 and 130.1 could be aligned with one another, or could be oriented at some other angle with respect to one another.

Figure 20:
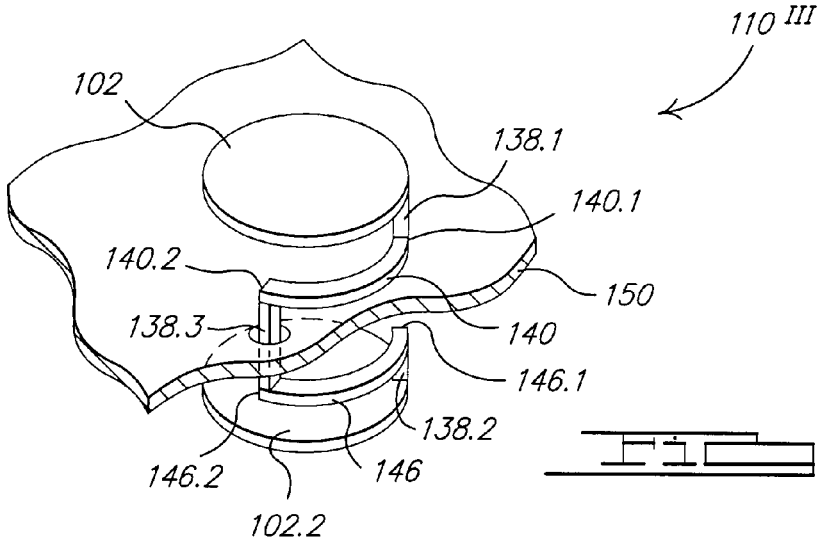
FIG. 20 illustrates an isometric view of a third embodiment of a discrete lens antenna element, isolated from associated dielectric substrates.
Figure 21:
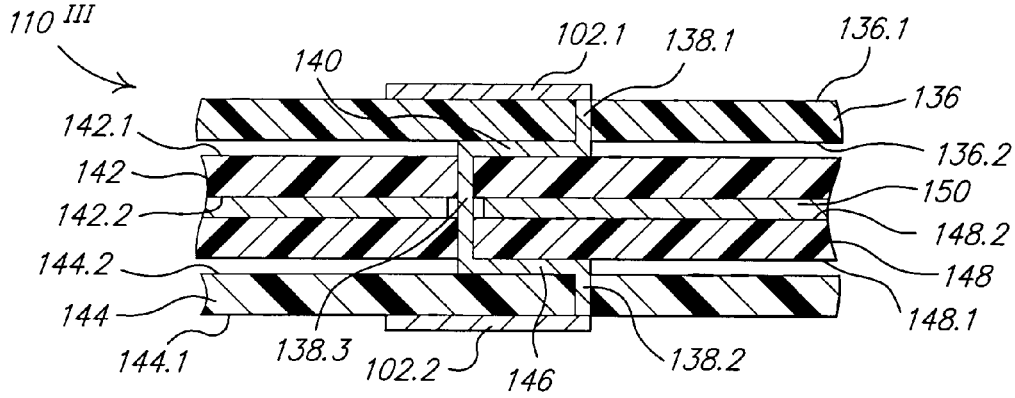
FIG. 21 illustrates a cross sectional view of the third embodiment of the discrete lens antenna element.

Referring to FIGS. 20 and 21, in accordance with a third embodiment of a lens element $\mathbf{110}^{III}$ of the planar lens 100.1, one or more delay lines 114 may be located between the first 102.1 and second 102.2 patch antenna elements—rather than adjacent thereto as in the first and second embodiments of the lens element $110^{I}$, $110^{II}$—so that the delay lines 114 are shadowed by the associated first 102.1 and second 102.2 patch antenna elements. For example, in one embodiment, the first patch antenna element 102.1 on a first side 136.1 of a first dielectric substrate 136 is connected with a first conductive via 138.1 through the first dielectric substrate 136 to a first end 140.1 of a first delay line 140 located between the second side 136.2 of the first dielectric substrate 136 and a first side 142.1 of a second dielectric substrate 142. Similarly, the second patch antenna element 102.2 on a first side 144.1 of a third dielectric substrate 144 is connected with a second conductive via 138.2 through the third dielectric substrate 144 to a first end 146.1 of a second delay line 146 located between the second side 144.2 of the third dielectric substrate 144 and a first side 148.1 of a fourth dielectric substrate 148. A third conductive via 138.3 interconnects the second ends 140.2, 146.2 of the first 140 and second 146 delay lines, and extends through the second 142 and fourth 148 dielectric substrates, and through a conductive ground plane 150 located between the second sides 142.2, 148.2 of the second 142 and fourth 148 dielectric substrates. The first 140 and second 146 delay lines are shadowed by the first 102.1 and second 102.2 patch antenna elements, and therefore do not substantially affect the respective radiation patterns of the first 102.1 and second 102.2 patch antenna elements. For example, the delay element 108 may comprise at least one transmission line comprising either a stripline, a microstrip line, an inverted microstrip line, a slotline, an image line, an insulated image line, a tapped image line, a coplanar stripline, or a coplanar waveguide line formed on the dielectric substrate(s) 112, 112.1, 112.2, for example, from a printed circuit board, for example, by subtractive technology, for example, chemical or ion etching, or stamping; or additive techniques, for example, deposition, bonding or lamination.

Figure 22:
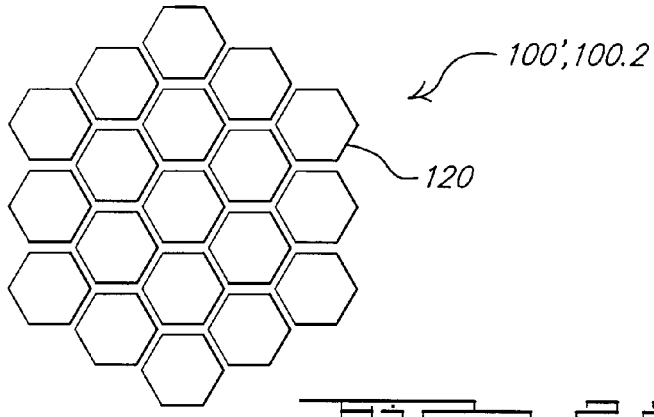
FIG. 22 illustrates a plan view of a second embodiment of a discrete lens array.

Referring to FIG. 22, in accordance with a second embodiment of a planar lens 100.2, the patch antennas 102 are hexagonally shaped so as to provide for a more densely packed discrete lens array 100'. The particular shape of the individual patch antennas 102 is not limiting, and for example, can be circular, rectangular, square, triangular, pentagonal, hexagonal, or some other polygonal shape or an arbitrary shape.

Notwithstanding that FIGS. 13, 15*a*, 15*b*, and 17-21 illustrate a plurality of delay lines 114.1, 114.2, 128.1, 128.2, 128.3, 128.4, 140, 146 interconnecting the first 102.1 and second 102.2 patch antenna elements, it should be understood that a single delay line 114—e.g. located on a surface of one of the dielectric substrates 112, 134, 136, 142, 144—could be used, interconnected to the first 102.1 and second 102.2 patch antenna elements with associated conductive paths.

Figure 23:
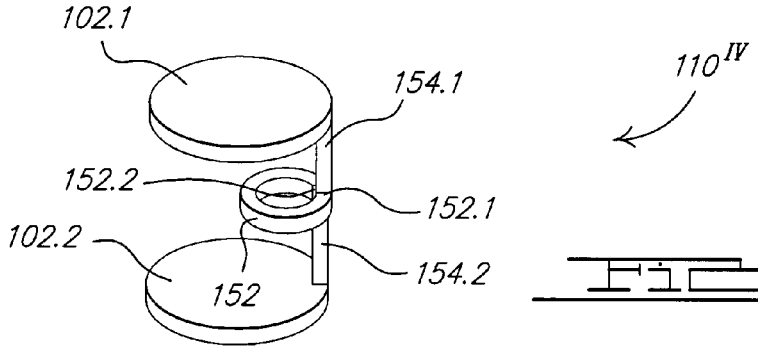
FIG. 23 illustrates an isometric view of a fourth embodiment of a discrete lens antenna element, isolated from associated dielectric substrates.
Figure 24A:
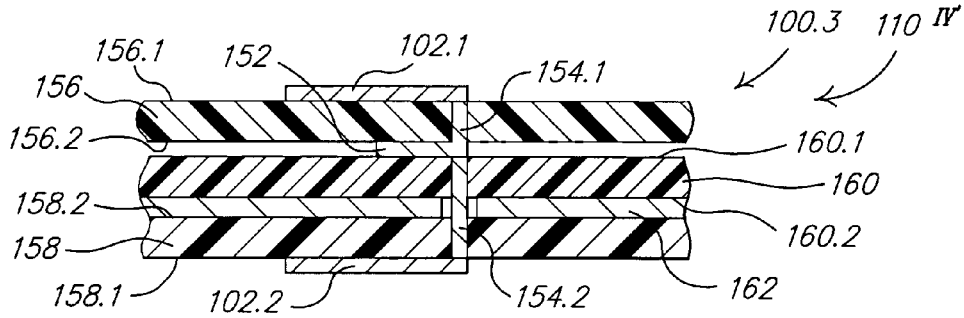
FIG. 24*a* illustrates a cross sectional view of the fourth embodiment of the discrete lens antenna element of a third embodiment of a discrete lens array.
Figure 24B:
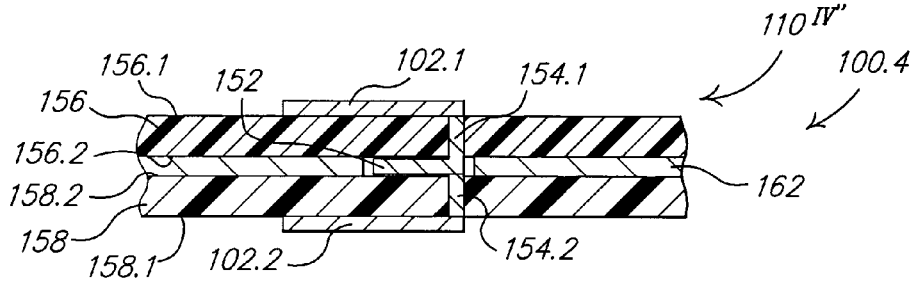
FIG. 24*b* illustrates a cross sectional view of the fourth embodiment of a discrete lens antenna element of a fourth embodiment of a discrete lens array.

Referring to FIGS. 23, 24*a* and 24*b*, in accordance with a fourth embodiment of a lens element $110^{IV}$ of the planar lens 100.1, the first 102.1 and second 102.2 patch antenna elements are interconnected with a delay line 152 located therebetweeen, wherein a first end 152.1 of the delay line 152 is connected with a first conductive via 154.1 to the first patch antenna element 102.1 and a second end 152.2 of the delay line 152 is connected with a second conductive via 154.2 to the second patch antenna element 102.2. Referring to FIG. 24*a*, in accordance with a third embodiment of a planar lens 100.3 incorporating the fourth embodiment of the lens element $110^{IV'}$, the first patch antenna element 102.1 is located on a first side 156.1 of a first dielectric substrate 156, and the second patch antenna element 102.2 is located on a first side 158.1 of a second dielectric substrate 158. The delay line 152 is located between the second side 156.2 of the first dielectric substrate 156 and a first side 160.1 of a third dielectric substrate 160 and the first conductive via 154.1 extends through the first dielectric substrate 156. A conductive ground plane 162 is located between the second sides 158.2, 160.2 of the second 158 and third 160 dielectric substrates, respectively, and the second conductive via 154.2 extends through the second 158 and third 160 dielectric substrates and through the conductive ground plane 162. Referring to FIG. 24*b*, a fourth embodiment of a planar lens 100.4 incorporates the fourth embodiment of a lens element $110^{IV''}$ illustrated in FIG. 23, without the third dielectric substrate 160 of the third embodiment of the planar lens 100.3 illustrated in FIG. 24*a*, wherein the delay line 152 and the conductive ground plane 162 are coplanar between the second sides 156.2, 158.2 of the first 156 and second 158 dielectric substrates, and are insulated or separated from one another.

The discrete lens array 100 does not necessarily have to incorporate a conductive ground plane 122, 136, 150, 162. For example, in the fourth embodiment of a planar lens 100.4 illustrated in FIG. 24*b*, the conductive ground plane 162 is optional, particularly if a closely packed array of patch antennas 102 were used as illustrated in FIG. 22. Furthermore, the first embodiment of a lens element $110^{I}$ illustrated in FIG. 18 could be constructed with the first 102.1 and second 102.2 patch antenna elements on opposing sides of a single dielectric substrate 112.

Figure 25:
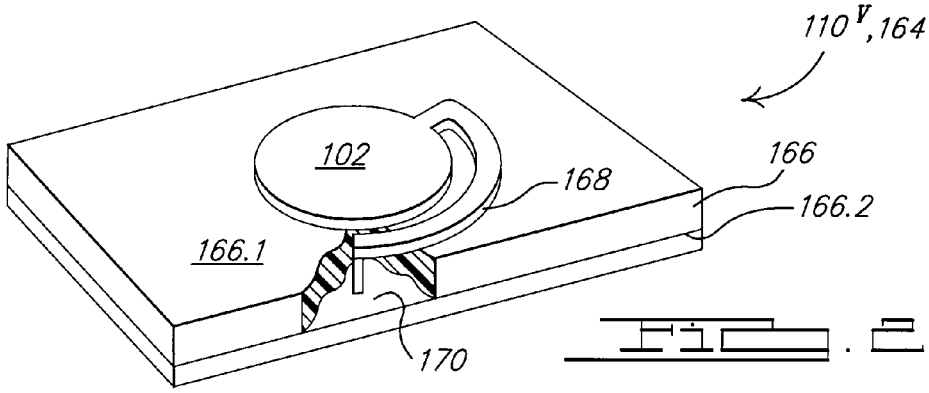
FIG. 25 illustrates a fragmentary cross sectional isometric view of a fifth embodiment of a discrete lens antenna element of a reflective discrete lens array.
Figure 26:
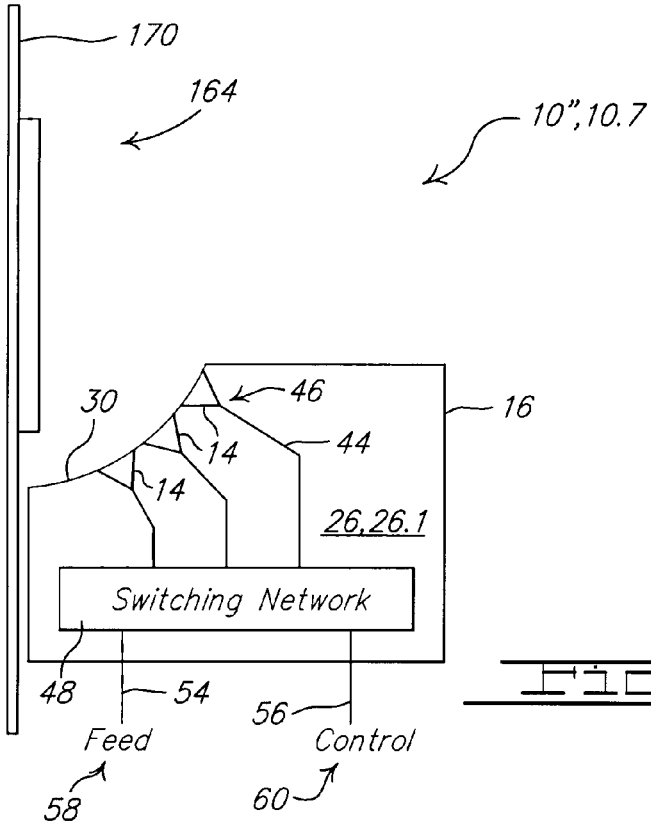
FIG. 26 illustrates a seventh embodiment of a multi-beam antenna, comprising a discrete lens array and a reflector.

Referring to FIGS. 25 and 26, in accordance with the third aspect and a seventh embodiment of a multi-beam antenna 10, 10.7, and a fifth embodiment of a lens element $110^{V}$ illustrated in FIG. 26, a reflective discrete lens array 164 comprises a plurality of patch antennas 102 located on a first side 166.1 of a dielectric substrate 166 and connected via corresponding delay lines 168 that are terminated either with an open or short circuit, e.g. by termination at an associated conductive ground plane 170 on the second side 166.2 of the dielectric substrate 166, wherein the associated delays of the delay lines 168 are adapted—for example, as illustrated in FIG. 16—so as to provide a phase profile that emulates a dielectric lens, e.g. a dielectric electromagnetic lens 12''' as illustrated in FIG. 10 Accordingly, the reflective discrete lens array 164 acts as a reflector and provides for receiving electromagnetic energy in the associated patch antennas 102, and then reradiating the electromagnetic energy from the patch antennas 102 after an associated location dependent delay, so as to provide for focusing the reradiated electromagnetic energy in a desired direction responsive to the synthetic structure formed by the phase front of the reradiated electromagnetic energy responsive to the location dependent delay lines.

Referring to FIGS. 55*a*-57, in accordance with a fifth embodiment of a discrete lens array 100.5 incorporating a sixth embodiment of an associated lens element $110^{VI}$, the discrete lens array 100.5 comprises an assembly of a first set 300.1 of first broadside antenna elements 302.1 on a first side 304.1 of the discrete lens array 100.5, and a corresponding second set 300.2 of second broadside antenna elements 302.2 on a second side 304.2 of the discrete lens array 100.5, wherein the first 304.1 and second 304.2 sides face in opposing directions with respect to one another, and the first 302.1 and second 302.2 broadside antenna elements from the first 300.1 and second 300.2 sets are paired with one another. The first 302.1 and second 302.2 broadside antenna elements of each pair 306 are adapted to communicate with one another through an associated delay element 108, wherein the amount of delay, or phase shift, is a function of the location of the particular pair 306 of first 302.1 and second 302.2 broadside antenna elements in the discrete lens array 100.5 so as to emulate the behavior of an electromagnetic lens, for example, a spherical, plano-spherical, elliptical, cylindrical or plano-cylindrical lens. The delay as a function of location on the discrete lens array 100.5 is adapted to provide—in a transmit mode—for transforming a diverging beam of beam of electromagnetic energy 20 from an associated antenna element 14 at a focal point to a corresponding substantially collimated beam exiting the discrete lens array 100.5; and vice versa in a receive mode.

More particularly, the first set 300.1 of first broadside antenna elements 302.1, for example, patch antenna elements, are located on a first side 308.1 of a first dielectric substrate 308 and the second set 300.2 of second broadside antenna elements 302.2, for example, patch antenna elements, are located on a first side 310.1 of a second dielectric substrate 310, with the respective second sides 308.2, 310.2 of the first 308 and second 310 dielectric substrates facing one another across opposing sides of a central conductive layer 312 that is provided with associated coupling slots 314 associated with each pair 306 of first 302.1 and second 302.2 broadside antenna elements, wherein the associated coupling slots 314 provide for communication between the first 302.1 and second 302.2 broadside antenna elements of each pair 306, and are adapted to provide for the corresponding associated delay, for example, in accordance with the technical paper, "A planar filter-lens-array for millimeter-wave applications," by A. Abbaspour-Tamijani, K. Sarabandi, and G. M. Rebeiz in 2004 *AP-S Int. Symp. Dig*., Monterey, Calif., June 2004, or in accordance with the Ph.D. dissertation of A. Abbaspour-Tamijani entitled "Novel Components for Integrated Millimeter-Wave Front-Ends," University of Michigan, January/February 2004, both of which are incorporated herein by reference. For example, referring to FIG. 57 in accordance with one embodiment, the coupling slots 314 are "U-shaped"—i.e. similar to the end of a tuning fork—and in cooperation with the adjacent first 308 and second 310 dielectric substrates constitute a sandwiched coplanar-waveguide (CPW) resonant structure, wherein the associated phase delay can be adjusted by scaling the associated coupling slot 314, and/or adjusting the position of the coupling slot 314 relative to the associated first 302.1 and second 302.2 broadside antenna elements. Accordingly, the individual pairs 306 of first 302.1 and second 302.2 broadside antenna elements in combination with an associated delay element 108 constitute a bandpass filter with radiative ports which can each be modeled as a three-pole filter based upon the corresponding three resonators of the associated first 302.1 and second 302.2 broadside antenna elements and the associated coupling slot 314. This arrangement is also known as an Antenna-Filter-Antenna (AFA) configuration.

For example, the first 308 and second 310 dielectric substrates may be constructed of a material with relatively low loss at an operating frequency, examples of which include DUROID®, a TEFLON® containing material, a ceramic material, depending upon the frequency of operation. For example, in one embodiment, the first 308 and second 310 dielectric substrates comprise DUROID® with a TEFLON® substrate of about 15-20 mil thickness and a relative dielectric constant of about 2.2, wherein the first 302.1 and second 302.2 broadside antenna elements and the coupling slots 314 are formed, for example, by subtractive technology, for example, chemical or ion etching, or stamping; or additive techniques, for example, deposition, bonding or lamination, from associated conductive layers bonded to the associated first 308 and second 310 dielectric substrates. The first 302.1 and second 302.2 broadside antenna elements may, for example, comprise microstrip patches, dipoles or slots.

Similarly, it should be understood that notwithstanding that the above-described lens elements 110, 110$^{I}$-110$^{V}$ of the above-described discrete lens arrays 100, 100.1-100.4 have been illustrated using associated patch antennas/patch antenna elements 102.1, 102.2, the patch antennas/patch antenna elements 102.1, 102.2 of above-described lens elements 110, 110$^{I}$-110$^{V}$ of the above-described discrete lens arrays 100, 100.1-100.4 could in general be broadside antennas/broadside antenna elements 302.1, 302.2, the latter of which may, for example, comprise microstrip patches, dipoles or slots.

In the sixth embodiment of the multi-beam antenna 10.6 illustrated in FIG. 12, and a seventh embodiment of a multi-beam antenna 10.7 illustrated in FIG. 26, which correspond in operation to the first and fourth embodiments of the multi-beam antenna 10.1, 10.4 illustrated in FIGS. 1 and 10 respectively, the discrete lens array 100, 164 is adapted to cooperate with a plurality of antenna feed elements 14, e.g. end-fire antenna element 14.1 located along the edge of a dielectric substrate 16 having an edge contour 30 adapted to cooperate with the focal surface of the associated discrete lens array 100, 164, wherein the antenna feed elements 14 are fed with a feed signal 28 coupled thereto through an associated switching network 48, whereby one or a combination of antenna feed elements 14 may be fed so as to provide for one or more beams of electromagnetic energy 20, the direction of which can be controlled responsive to a control signal 60 applied to the switching network 48.

Figure 27:
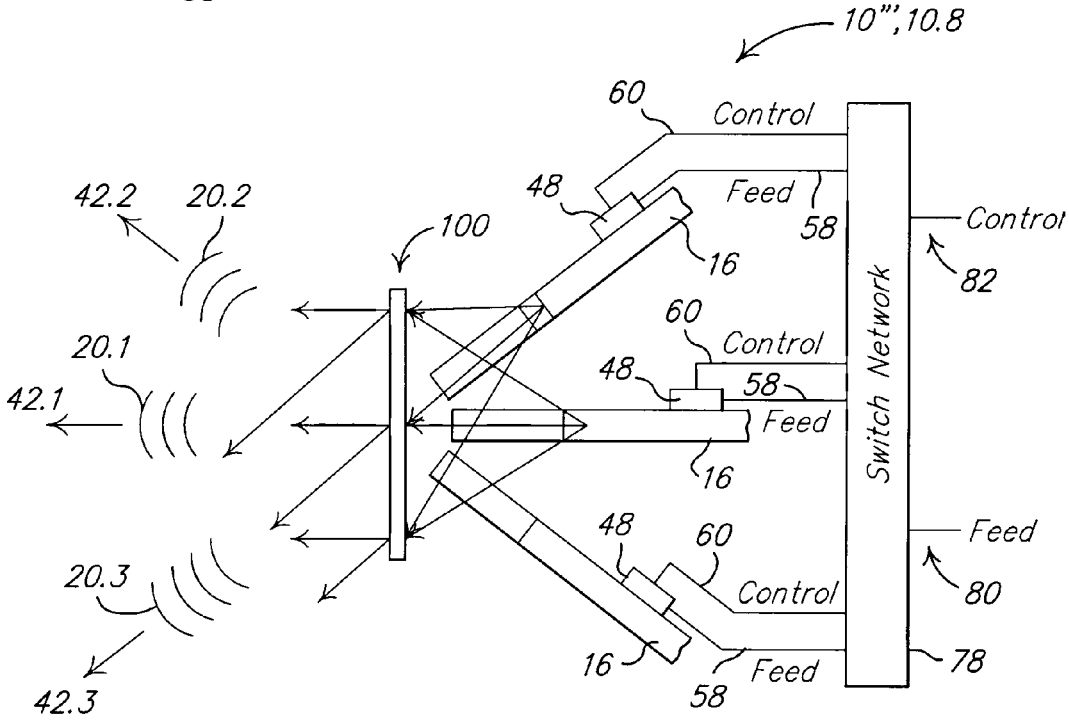
FIG. 27 illustrates an eighth embodiment of a multi-beam antenna.

Referring FIG. 27, in accordance with the fourth aspect and an eighth embodiment of a multi-beam antenna 10''', 10.8, which corresponds in operation to the fifth embodiment of the multi-beam antenna 10.5 illustrated in FIG. 11, the discrete lens array 100 can be adapted to cooperate with a plurality of dielectric substrates 16, each comprising a set of antenna feed elements 14 and operating in accordance with the description hereinabove. Each set of antenna feed elements 14 generates or receives (or is capable of generating or receiving) an associated set of beams of electromagnetic energy 20.1, 20.2 and 20.3, each having associated directions 42.1, 42.2 and 42.3, responsive to the associated feed 58 and control 60 signals. The associated feed 58 and control 60 signals are either directly applied to the associated switch network 48 of the respective sets of antenna feed elements 14, or are applied thereto through a second switch network 78 have associated feed 80 and control 82 ports, each comprising at least one associated signal. Accordingly, the multi-beam antenna 10.8 provides for transmitting or receiving one or more beams of electromagnetic energy over a three-dimensional space.

Generally, because of reciprocity, any of the above-described antenna embodiments can be used for either transmission or reception or both transmission and reception of electromagnetic energy.

The discrete lens array 100, 164 in combination with planar, end-fire antenna elements 14.1 etched on a dielectric substrate 16 provides for a multi-beam antenna 10 that can be manufactured using planar construction techniques, wherein the associated antenna feed elements 14 and the associated lens elements 110 are respectively economically fabricated and mounted as respective groups, so as to provide for an antenna system that is relatively small and relatively light weight.

Referring to FIGS. 28-30, 34 and 35, in accordance with a fifth aspect, a multi-beam antenna 10$^{iv}$ comprises a dielectric substrate 16 having a convex profile 202—e.g. circular, semi-circular, quasi-circular, elliptical, or some other profile shape as may be required—with a plurality of end-fire antenna elements 14.1 etched into a first conductive layer 36.1 on the first side 16.1 of the dielectric substrate 16. The plurality of end-fire antenna elements 14.1 are adapted to radiate a corresponding plurality of beams of electromagnetic energy 20 radially outwards from the convex profile 202 of the dielectric substrate 16, or to receive a corresponding plurality of beams of electromagnetic energy 20 propagating towards the convex profile 202 of the dielectric substrate 16. For example, the end-fire antenna elements 14.1 are illustrated as abutting the convex profile 202.

The dielectric substrate 16 is, for example, a material with relatively low loss at an operating frequency, for example, DUROID®, a TEFLON® containing material, a ceramic material, or a composite material such as an epoxy/fiberglass composite. Moreover, in one embodiment, the dielectric substrate 16 comprises a dielectric 16' of a circuit board 34, for example, a printed or flexible circuit 34.1' comprising at least one conductive layer 36 adhered to the dielectric substrate 16, from which the end-fire antenna elements 14.1 and other associated circuit traces 38 are formed, for example, by subtractive technology, for example, chemical or ion etching, or stamping; or additive techniques, for example, deposition, bonding or lamination. For example, the multi-beam antenna $\mathbf{10}^{iv}$ illustrated in FIGS. 30, 34 and 35 was fabricated on an RT/DUROID® 5880 substrate with a copper layer of 17 micrometers thickness on either side with a fabrication process using a one-mask process with one lithography step.

An end-fire antenna element 14.1 may, for example, comprise either a Yagi-Uda antenna, a coplanar horn antenna (also known as a tapered slot antenna), a Vivaldi antenna, a tapered dielectric rod, a slot antenna, a dipole antenna, or a helical antenna, each of which is capable of being formed on the dielectric substrate 16, for example, from a printed or flexible circuit 34.1', for example, by subtractive technology, for example, chemical or ion etching, or stamping; or additive techniques, for example, deposition, bonding or lamination. The end-fire antenna element 14.1 could also comprise a monopole antenna, for example, a monopole antenna element oriented either in-plane or out-of-plane with respect to the dielectric substrate 16. Furthermore, the end-fire antenna elements 14.1 may be used for transmitting, receiving or both.

Figure 28:
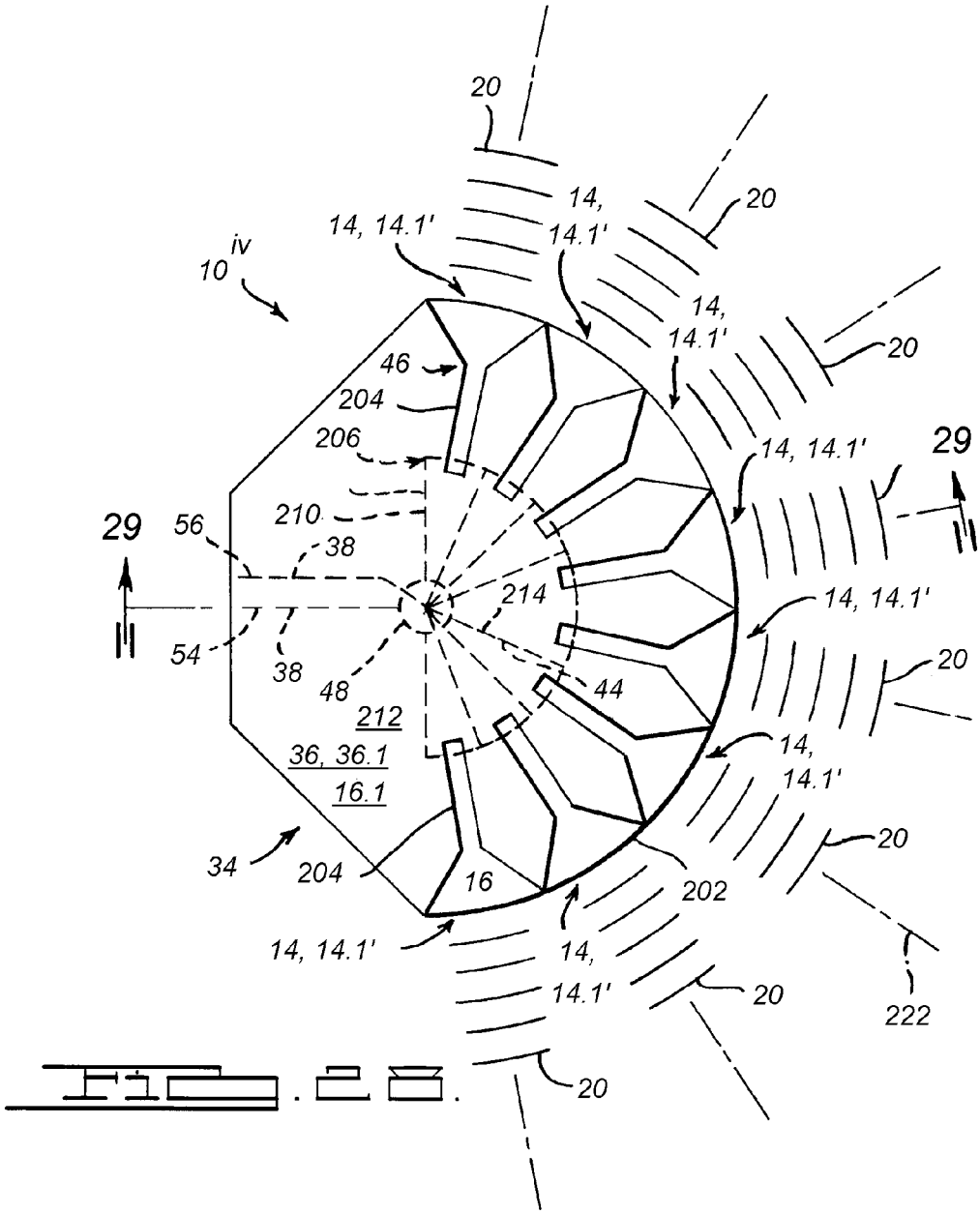
FIG. 28 illustrates a top plan view of a first embodiment of a fifth aspect of a multi-beam antenna.
Figure 29:
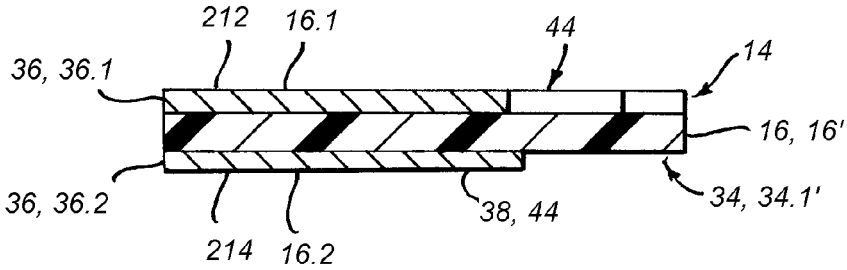
FIG. 29 illustrates a side cross-sectional view of the embodiment of FIG. 28.
Figure 30:
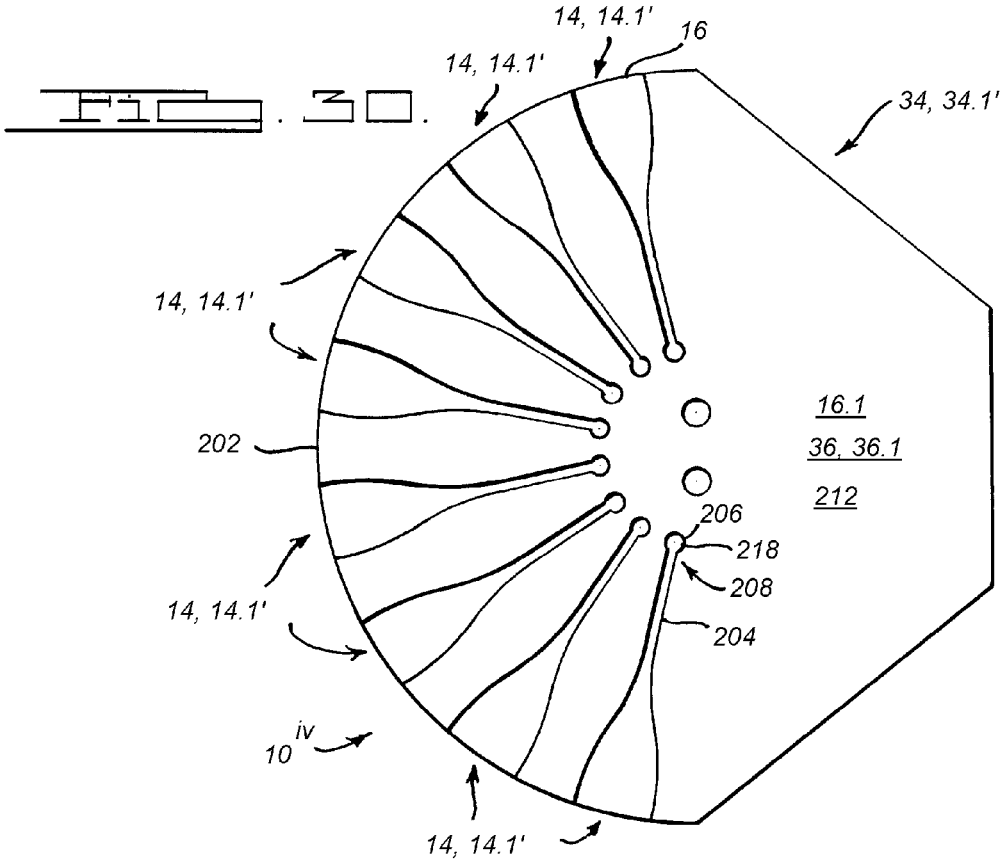
FIG. 30 illustrates a top plan view of an embodiment of the fifth aspect of the multi-beam antenna.
Figure 31:
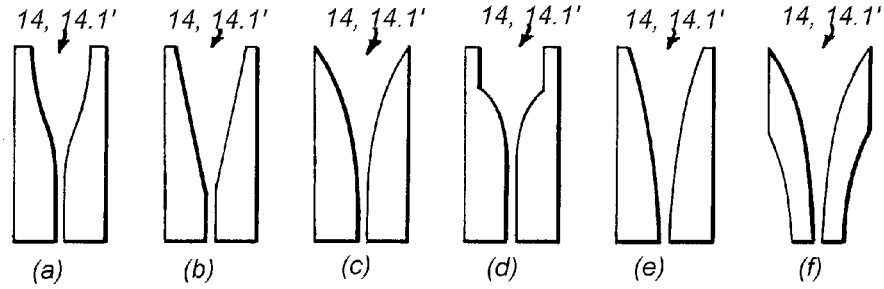
FIGS. 31*a*-31*f* illustrate various embodiments of tapered slot antenna elements.

For example, the embodiments illustrated in FIGS. 28 and 30 incorporate tapered-slot antennas 14.1' as the associated end-fire antenna elements 14.1. The tapered-slot antenna 14.1' is a surface-wave traveling-wave antenna, which generally allows wider band operation in comparison with resonant structures, such as dipole or Yagi-Uda antennas. The directivity of a traveling-wave antenna depends mostly upon length and relatively little on its aperture. The aperture is typically larger than a half free space wavelength to provide for proper radiation and low reflection. For a very short tapered-slot antenna 14.1', the input impedance becomes mismatched with respect to that of an associated slotline feed and considerable reflections may occur. Longer antennas generally provide for increased directivity. Traveling-wave antennas generally are substantially less susceptible to mutual coupling than resonant antennas, which makes it possible to place them in close proximity to each other without substantially disturbing the radiation pattern of the associated multi-beam antenna $\mathbf{10}^{iv}$.

Figure 32:
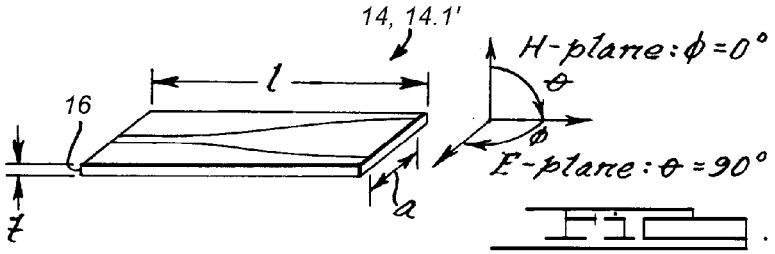
FIG. 32 illustrates a tapered slot antenna element and an associated coordinate system.

The tapered-slot antenna 14.1' comprises a slot in a conductive ground plane supported by a dielectric substrate 16. The width of the slot increases gradually in a certain fashion from the location of the feed to the location of interface with free space. As the width of the slot increases, the characteristic impedance increases as well, thus providing a smooth transition to the free space characteristic impedance of 120 times pi Ohms. Referring to FIGS. 31*a*-31*f*, a variety of tapered-slot antennas 14.1' are known, for example, a Fermi tapered slot antenna (FTSA) illustrated in FIGS. 30 and 31*a*; a linearly tapered slot antenna (LTSA) illustrated in FIGS. 28 and 31*b*; a Vivaldi exponentially tapered slot antenna (Vivaldi) illustrated in FIG. 31*c*; a constant width slot antenna (CWSA) illustrated in FIG. 31*d*; a broken linearly tapered slot antenna (BLTSA) illustrated in FIG. 31*e*; and a dual exponentially tapered slot antenna (DETSA) illustrated in FIG. 31*f*. Referring to FIG. 32, the tapered-slot antenna 14.1' exhibits an E-field polarization that is in the plane of the tapered-slot antenna 14.1'.

These different types of tapered-slot antennas 14.1' exhibit corresponding different radiation patterns, also depending on the length and aperture of the slot and the supporting substrate. Generally, for the same substrate with the same length and aperture, the beamwidth is smallest for the CWSA, followed by the LTSA, and then the Vivaldi. The sidelobes are highest for the CWSA, followed by the LTSA, and then the Vivaldi. The Vivaldi has theoretically the largest bandwidth due to its exponential structure. The BLTSA exhibits a wider −3 dB beamwidth than the LTSA and the cross-polarization in the D-plane (diagonal plane) is about 2 dB lower compared to LTSA and CWSA. The DETSA has a smaller −3 dB beamwidth than the Vivaldi, but the sidelobe level is higher, although for higher frequency, the sidelobes can be suppressed. However, the DETSA gives an additional degree of freedom in design especially with regard to parasitic effects due to packaging. The FTSA exhibits very low and the most symmetrical sidelobe level in E and H-plane and the −3 dB beamwidth is larger than the BLTSA.

The multi-beam antenna $\mathbf{10}^{iv}$ may further comprise at least one transmission line 44 on the dielectric substrate 16 operatively connected to a corresponding at least one feed port 46 of a corresponding at least one of the plurality of end-fire antenna elements 14.1 for feeding a signal thereto or receiving a signal therefrom. For example, the at least one transmission line 44 may comprise either a stripline, a microstrip line, an inverted microstrip line, a slotline, an image line, an insulated image line, a tapped image line, a coplanar stripline, or a coplanar waveguide line formed on the dielectric substrate 16, for example, of a printed or flexible circuit 34.1', for example, by subtractive technology, for example, chemical or ion etching, or stamping; or additive techniques, for example, deposition, bonding or lamination.

Figure 33:
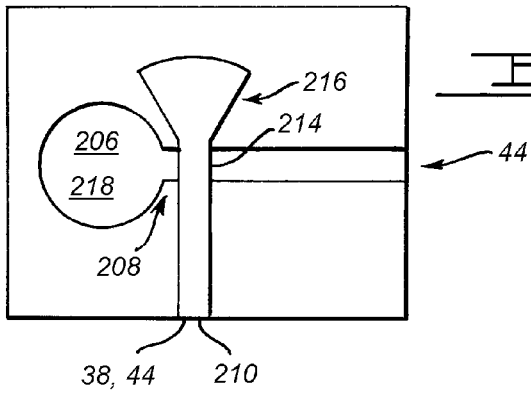
FIG. 33 illustrates a junction where a microstrip line is adapted to couple to a slotline feeding a tapered slot antenna.
Figure 34:
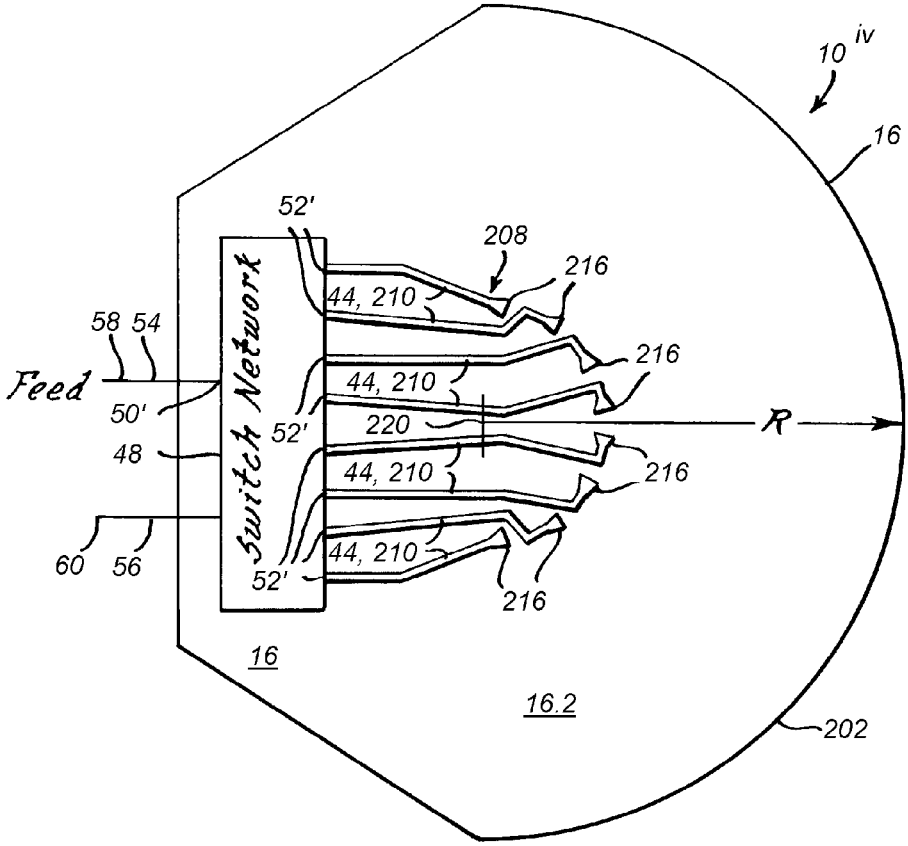
FIG. 34 illustrates a bottom view of the embodiment of the multi-beam antenna illustrated in FIG. 30 interfaced to an associated switch network.

Referring to FIGS. 28, 30 and 33, each of the tapered-slot endfire antenna elements 14.1' interface with an associated slotline 204 by which energy is coupled to or from the tapered-slot endfire antenna element 14.1'. The slotlines 204 are terminated with at a terminus 206 on the first side 16.1 of the dielectric substrate 16, proximate to which the slotlines 204 is electromagnetically coupled at a coupling location 208 to a microstrip line 210 on the opposite or second side 16.2 of the dielectric substrate 16, wherein the first conductive layer 36.1 on the first side 16.1 of the dielectric substrate 16 constitutes an associated conductive ground layer 212 of the microstrip line 210, and the conductor 214 of the microstrip line 210 is formed from a second conductive layer 36.2 on the second side 16.2 of the dielectric substrate 16.

Referring to FIGS. 28, and 33-35, a transition between the microstrip line 210 and the slotline 204 is formed by etching the slotline 204 into the conductive ground layer 212 of the microstrip line 210 and is crossed by the conductor 214 of the microstrip line 210 oriented substantially perpendicular to the axis of the slotline 204, as is illustrated in detail in FIG. 33. A transition distance of about one wavelength provides matching the 50 Ohm impedance of the microstrip line 210 to the 100 Ohm impedance of the slotline 204. The coupling of the fields between the microstrip line 210 and slotline 204 occurs through an associated magnetic field, and is strongest when the intersection of the conductor 214 and slotline 204 occurs proximate to a short circuit of the microstrip line 210—where the current therein is a maximum—and an open circuit of the slotline 204. Because short circuits in a microstrip line 210 require via holes, it is easier to terminate the microstrip line 210 in an open circuit a quarter guided wavelength from the transition intersection, where quarter guided wavelength is that of the microstrip line 210. A quarter-wave radial stub 216 can provide for relatively wider bandwidth. An open circuit in the slotline 204 is created by truncating the conductive ground layer 212, which is generally impractical. Alternatively, and preferably, the slotline 204 is terminated with a short circuit and recessed from the intersection by a quarter guided wavelength of the slotline 204. The bandwidth can be increased by realizing the quarter-wave termination in a circular disc aperture 218, which is an approximation of an open circuit of a slotline 204. Generally, the open-circuit behavior improves with increasing radius of the circular disc aperture 218. Theoretically, the circular disc aperture 218 behaves like a resonator. The circular disc aperture 218 is capacitive in nature, and behaves as an open circuit provided that the operating frequency is higher than the resonance frequency of the circular disc aperture 218 resonator.

The multi-beam antenna $\mathbf{10}^{iv}$ may further comprise a switching network 48 having at least one first port 50' and a plurality of second ports 52', wherein the at least one first port 50' is operatively connected—for example, via at least one above described transmission line 44—to a corporate antenna feed port 54, and each second port 52' of the plurality of second ports 52' is connected—for example, via at least one transmission line 44—to a respective feed port 46 of a different end-fire antenna element 14.1 of the plurality of end-fire antenna elements 14.1. The switching network 48 further comprises at least one control port 56 for controlling which second ports 52' are connected to the at least one first port 50' at a given time. The switching network 48 may, for example, comprise either a plurality of micro-mechanical switches, PIN diode switches, transistor switches, or a combination thereof, and may, for example, be operatively connected to the dielectric substrate 16, for example, by surface mount to an associated conductive layer 36 of a printed or flexible circuit 34.1', inboard of the end-fire antenna elements 14.1. For example, the switching network 48 may be located proximate to the center 220 of the radius R of curvature of the dielectric substrate 16 so as to be proximate to the associated coupling locations 208 of the associated microstrip lines 210. The switching network 48, if used, need not be collocated on a common dielectric substrate 16, but can be separately located, as, for example, may be useful for relatively lower frequency applications, for example, 1-20 GHz.

In operation, a feed signal 58 applied to the corporate antenna feed port 54 is either blocked—for example, by an open circuit, by reflection or by absorption,—or switched to the associated feed port 46 of one or more end-fire antenna elements 14.1, via one or more associated transmission lines 44, by the switching network 48, responsive to a control signal 60 applied to the control port 56. It should be understood that the feed signal 58 may either comprise a single signal common to each end-fire antenna element 14.1, or a plurality of signals associated with different end-fire antenna elements 14.1. Each end-fire antenna element 14.1 to which the feed signal 58 is applied launches an associated electromagnetic wave into space. The associated beams of electromagnetic energy 20 launched by different end-fire antenna elements 14.1 propagate in different associated directions 222. The various beams of electromagnetic energy 20 may be generated individually at different times so as to provide for a scanned beam of electromagnetic energy 20. Alternatively, two or more beams of electromagnetic energy 20 may be generated simultaneously. Moreover, different end-fire antenna elements 14.1 may be driven by different frequencies that, for example, are either directly switched to the respective end-fire antenna elements 14.1, or switched via an associated switching network 48 having a plurality of first ports 50', at least some of which are each connected to different feed signals 58.

Alternatively, the multi-beam antenna $\mathbf{10}^{iv}$ may be adapted so that the respective signals are associated with the respective end-fire antenna elements 14.1 in a one-to-one relationship, thereby precluding the need for an associated switching network 48. For example, each end-fire antenna element 14.1 can be operatively connected to an associated signal through an associated processing element. As one example, with the multi-beam antenna $\mathbf{10}^{iv}$ configured as an imaging array, the respective end-fire antenna elements 14.1 are used to receive electromagnetic energy, and the corresponding processing elements comprise detectors. As another example, with the multi-beam antenna $\mathbf{10}^{iv}$ configured as a communication antenna, the respective end-fire antenna elements 14.1 are used to both transmit and receive electromagnetic energy, and the respective processing elements comprise transmit/receive modules or transceivers.

Figure 35:
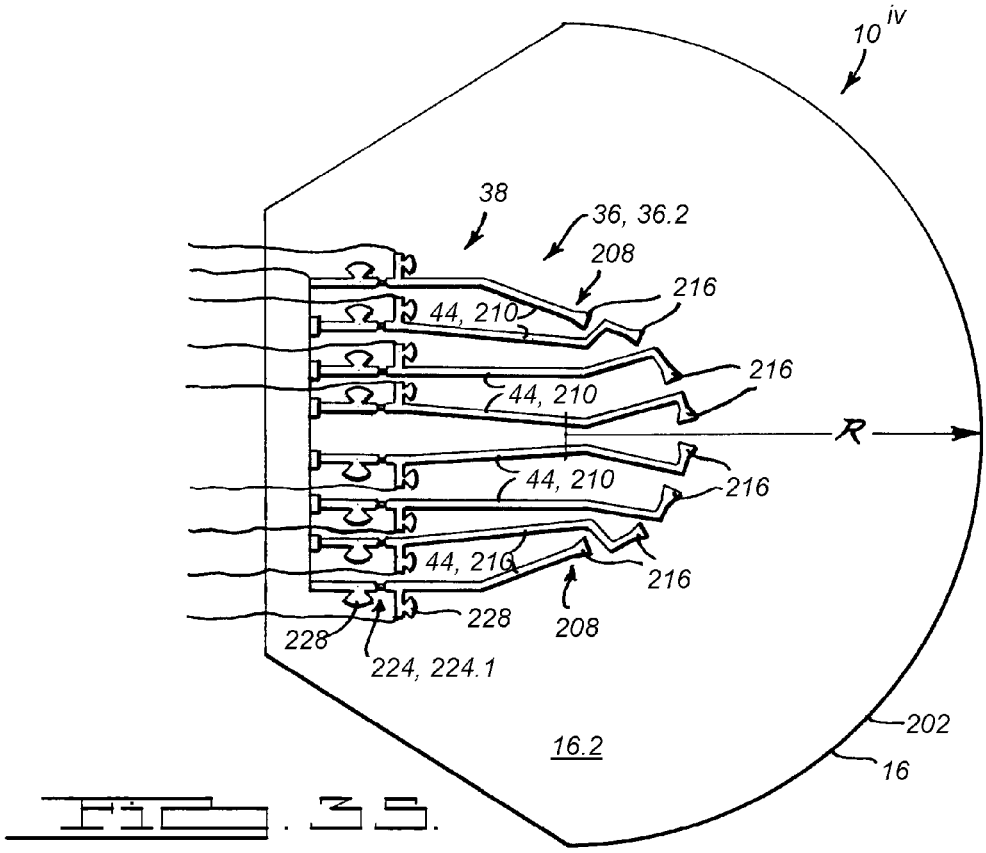
FIG. 35 illustrates a bottom view of the embodiment of the multi-beam antenna illustrated in FIG. 30 with associated receiver circuitry.
Figure 36:
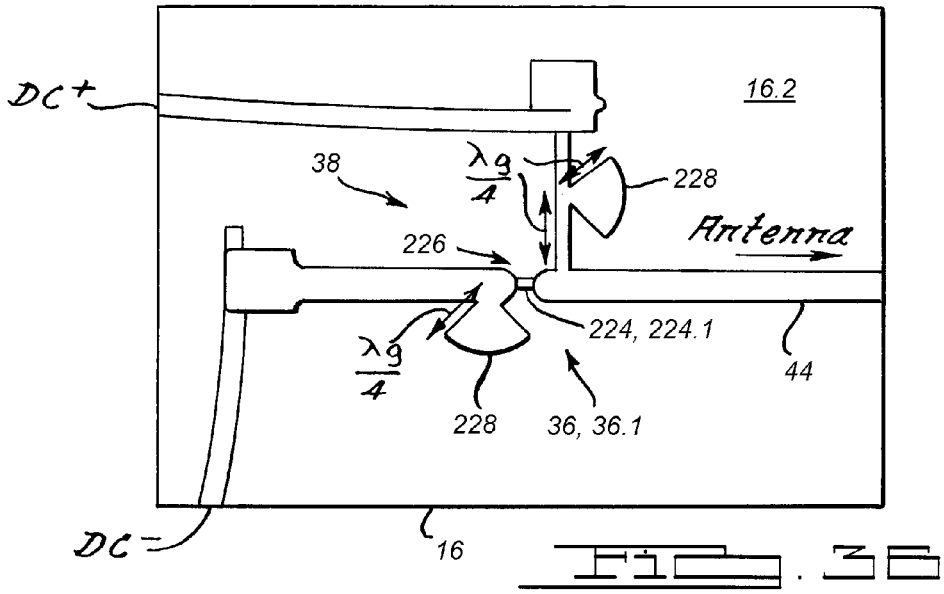
FIG. 36 illustrates a detailed view of the receiver circuitry for the embodiment illustrated in FIG. 35.
Figure 37:
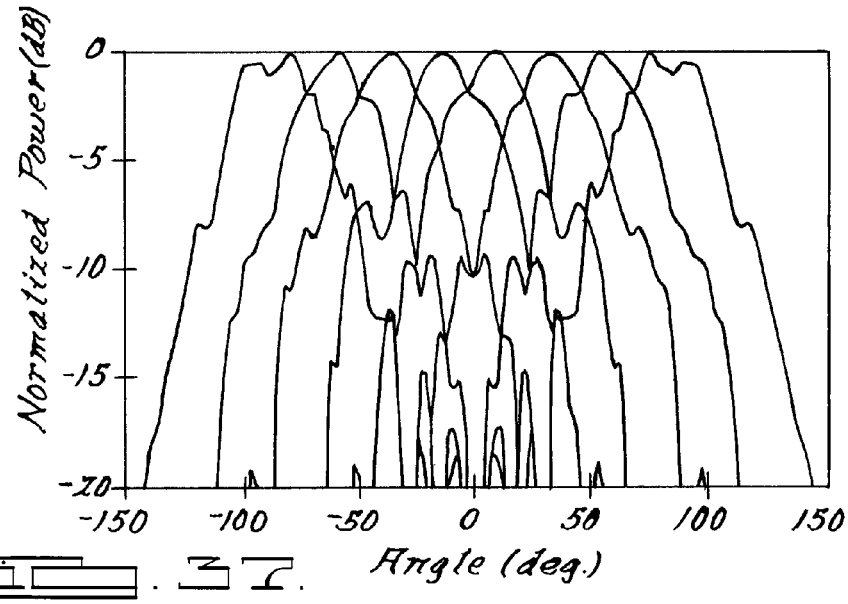
FIG. 37 illustrates an antenna gain pattern for the multi-beam antenna illustrated in FIGS. 30 and 35.

For example, referring to FIGS. 35 and 36, a multi-beam antenna $\mathbf{10}^{iv}$ is adapted with a plurality of detectors 224 for detecting signals received by associated end-fire antenna elements 14.1 of the multi-beam antenna $\mathbf{10}^{iv}$, for example, to provide for making associated radiation pattern measurements. Each detector 224 comprises a planar silicon Schottky diode 224.1 mounted with an electrically conductive epoxy across a gap 226 in the microstrip line 210. For higher sensitivity, the diode 224.1 is DC-biased. Two quarter wavelength-stub filters 228 provide for maximizing the current at the location of the diode detector 224.1 while preventing leakage into the DC-path. FIG. 37 illustrates an E-plane radiation pattern for the multi-beam antenna $\mathbf{10}^{iv}$ illustrated in FIGS. 30 and 35, configured as a receiving antenna.

The tapered-slot endfire antenna elements 14.1' provide for relatively narrow individual E-plane beam-widths, but inherently exhibit relatively wider H-plane beam-widths, of the associated beams of electromagnetic energy 20.

Figure 38A:
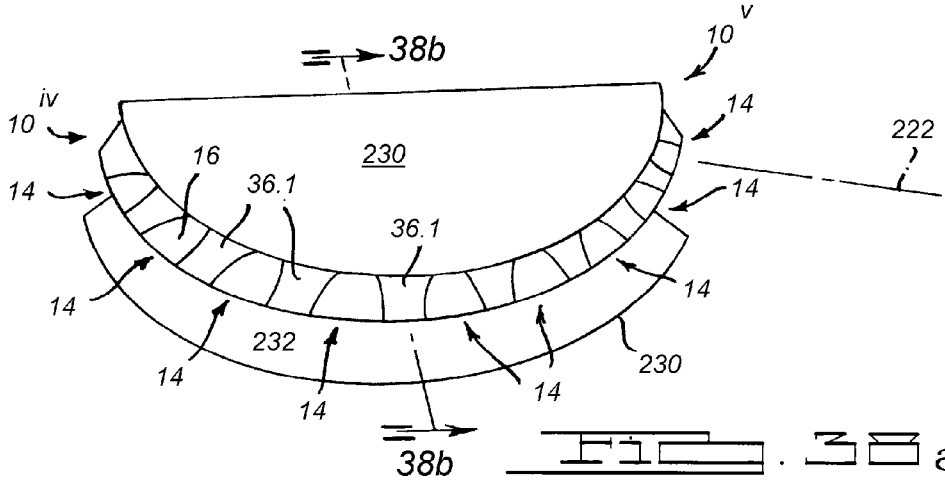
FIG. 38*a* illustrates an isometric view of an embodiment of a sixth aspect of a multi-beam antenna incorporating a bi-conical reflector.
Figure 38B:
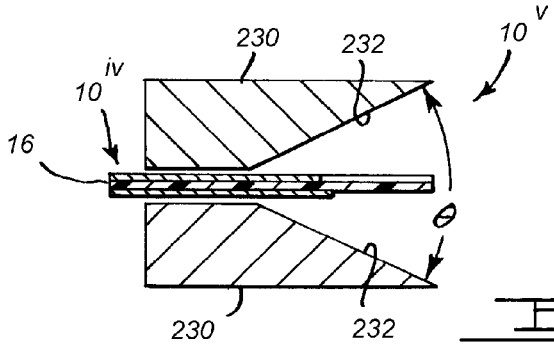
FIG. 38*b* illustrates a cross-sectional view of the embodiment of the multi-beam antenna illustrated in FIG. 38*a* incorporating a bi-conical reflector.

Referring to FIGS. 38*a* and 38*b*, in accordance with a sixth aspect of a multi-beam antenna $\mathbf{10}^{v}$, the H-plane beam-width may be reduced, and the directivity of the multi-beam antenna $\mathbf{10}^{iv}$ may be increased, by sandwiching the above-described multi-beam antenna $\mathbf{10}^{iv}$ within a bi-conical reflector 230, so as to provide for a horn-like antenna in the H-plane. In one embodiment, the opening angle between the opposing faces 232 of the bi-conic reflector is about ninety (90) degrees and the lateral dimensions coincide with that of the dielectric substrate 16. The measured radiation patterns in E-plane of this embodiment exhibited a −3 dB beamwidth of 26 degrees and the cross-over of adjacent beams occurs at the −2.5 dB level. The sidelobe level was about −6 dB, and compared to the array without a reflector, the depth of the nulls between main beam and sidelobes was substantially increased. In the H-plane, the −3 and −10 dB beamwidths were 35 degrees and 68 degrees respectively, respectively, and the sidelobe level was below −20 dB. The presence of the bi-conical reflector 230 increased the measured gain by 10 percent. Although the improvement in gain is relatively small, e.g. about 10 percent, the bi-conical reflector 230 is beneficial to the H-plane radiation pattern.

Referring to FIGS. 39*a* and 39*b*, in accordance with a seventh aspect of a multi-beam antenna $\mathbf{10}^{vi}$, the H-plane beam-width may be reduced, and the directivity of the multi-beam antenna $\mathbf{10}^{iv}$ may be increased, by using a conformal cylindrical dielectric lens 234 which is bent along its cylindrical axis so as to conform to the convex profile 202 of the dielectric substrate 16, so as to provide for focusing in the H-plane without substantially affecting the E-plane radiation pattern. For example, the conformal cylindrical dielectric lens 234 could be constructed from either Rexolite™, Teflon™, polyethylene, or polystyrene; or a plurality of different materials having different refractive indices. Alternatively, the conformal cylindrical dielectric lens 234 could have a plano-cylindrical cross-section, rather than the circular cross-section as illustrated in FIG. 39*b*. In accordance with another embodiment, the conformal cylindrical dielectric lens 234 may be adapted to also act as a radome so as to provide for protecting the multi-beam antenna $\mathbf{10}^{vi}$ from the adverse environmental elements (e.g. rain or snow) and factors, or contamination (e.g. dirt).

Referring to FIGS. 40*a* and 40*b*, in accordance with an eighth aspect of a multi-beam antenna $\mathbf{10}^{vii}$, the H-plane beam-width may be reduced, and the directivity of the multi-beam antenna $\mathbf{10}^{iv}$ may be increased, by using a discrete lens array 236, the surface (e.g. planar surface) of which is oriented normal to the dielectric substrate 16 and—in a direction normal to the surface of the discrete lens array 236—is adapted to conform to the convex profile 202 of the dielectric substrate 16.

Referring to FIGS. 14-24*b*, 41 and 42, the discrete lens array 236 would comprise a plurality of first patch antennas 102.1 on one side of an associated dielectric substrate 112 of the discrete lens array 236 that are connected via associated delay elements 114', e.g. delay lines 114, to a corresponding plurality of second patch antennas 102.2 on the opposites side of the associated dielectric substrate 112 of discrete lens array 236, wherein the length of the delay lines 114 decreases with increasing distance—in a direction that is normal to the dielectric substrate 16—from the center 238 of the discrete lens array 236 which is substantially aligned with the dielectric substrate 16. The delay lines 114 can be constructed by forming meandering paths of appropriate length using printed circuit technology. One example of a cylindrical lens array is described by D. Popovic and Z. Popovic in "Mutlibeam Antennas with Polarization and Angle Diversity", IEEE Transactions on Antennas and Propagation, Vol. 50, No. 5, May 2002, which is incorporated herein by reference.

Figure 41:
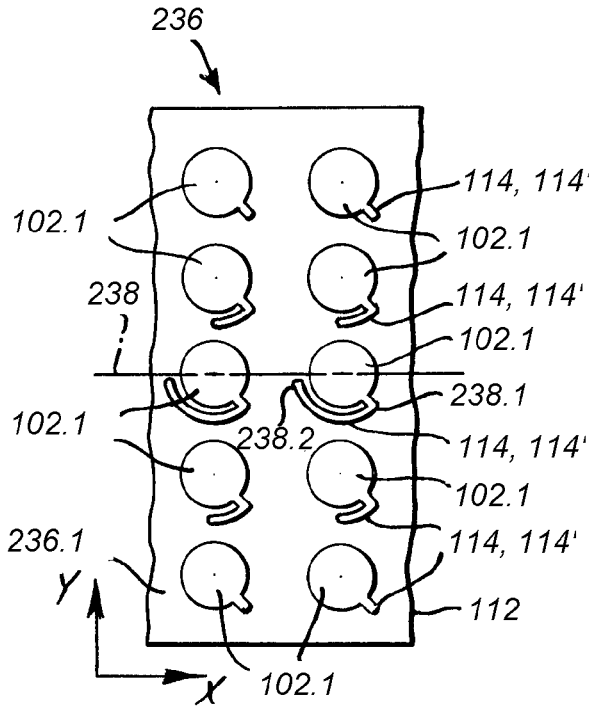
FIG. 41 illustrates a first side of a planar discrete lens array.

In one embodiment of a discrete lens array 236, the patch antennas 102.1, 102.2 comprise conductive surfaces on the dielectric substrate 112, and the delay element 114' coupling the patch antennas 102.1, 102.2 of the first 236.1 and second 236.2 sides of the discrete lens array 236 comprise delay lines 114, e.g. microstrip or stipline structures, that are located adjacent to the associated patch antennas 102.1, 102.2 on the underlying dielectric substrate 112. The first ends 238.1 of the delay lines 114 are connected to the corresponding patch antennas 102.1, 102.2, and the second ends 238.2 of the delay lines 114 are interconnected to one another with a conductive path, for example, with a conductive via 118 though the dielectric substrate 112. FIG. 41 illustrates the delay lines 114 arranged so as to provide for feeding the associated first 102.1 and second 102.2 sets of patch antennas at the same relative locations.

In another embodiment, the discrete lens array 236 is adapted in accordance with an Antenna-Filter-Antenna configuration, for example, in accordance with the fifth embodiment of the discrete lens array 100.5 incorporating the sixth embodiment of the associated lens element $\mathbf{110}^{VI}$ described hereinabove.

Figure 42:
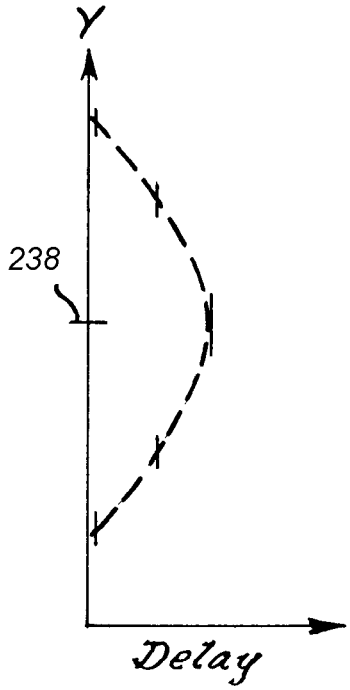
FIG. 42 illustrates a plot of delay as a function of transverse location on the planar discrete lens array of FIG. 41.

Referring to Referring to FIG. 42, the amount of delay caused by the associated delay lines 114 is made dependent upon the location of the associated patch antenna 102 in the discrete lens array 236, and, for example, is set by the length of the associated delay lines 114, as illustrated by the configuration illustrated in FIG. 41, so as to emulate the phase properties of a convex electromagnetic lens, e.g. a conformal cylindrical dielectric lens 234. The shape of the delay profile illustrated in FIG. 42 can be of various configurations, for example, 1) uniform for all radial directions, thereby emulating a spherical lens; 2) adapted to incorporate an azimuthal dependence, e.g. so as to emulate an elliptical lens; 3) adapted to provide for focusing in one direction only, e.g. in the elevation plane of the multi-beam antenna $\mathbf{10}^{vii}$, e.g. so as to emulate a conformal cylindrical dielectric lens 234, or 4) adapted to direct the associated radiation pattern either above or below the plane of the associated multi-beam antenna $\mathbf{10}^{vii}$, e.g. so as to mitigate against reflections from the ground, i.e. clutter.

Figure 43A:
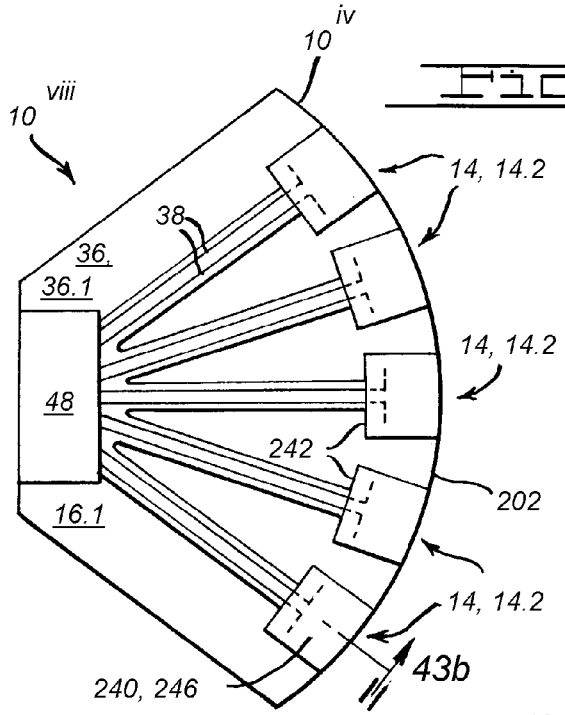
FIG. 43*a* illustrates a top plan view of an embodiment of a ninth aspect of a multi-beam antenna incorporating a dipole antenna adapted to cooperate with an associated corner reflector.
Figure 43B:
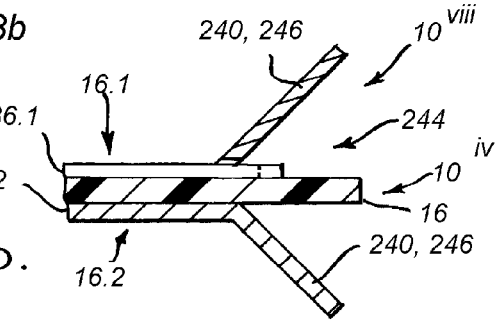
FIG. 43*b* illustrates a cross-sectional view of the embodiment of the multi-beam antenna illustrated in FIG. 43*a* incorporating a dipole antenna and an associated corner reflector.

Referring to FIGS. 43*a* and 43*b*, in accordance with a ninth aspect of a multi-beam antenna $\mathbf{10}^{viii}$, the dielectric substrate 16 with a plurality of associated end-fire antenna elements 14.1 is combined with associated out-of-plane reflectors 240 above and below the dielectric substrate 16, in addition to any that are etched into the dielectric substrate 16 itself, so as to provide for improved the radiation patterns of the etched end-fire antenna elements 14.1. For example, a dipole antenna 14.2 and an associated reflector portion 242 can be etched in at least one conductive layer 36 on the dielectric substrate 16. Alternatively, a Yagi-Uda element could used instead of the dipole antenna 14.2. The etched reflector portion 242 can also be extended away from the dielectric substrate 16 to form a planar corner reflector 244, e.g. by attaching relatively thin conductive plates 246 to the associated first 36.1 and second 36.2 conductive layers, e.g. using solder or conductive epoxy. For example, this would be similar to the metallic enclosures currently used to limit electromagnetic emissions and susceptibility on circuit boards. For example, the planar corner reflectors 244 are each illustrated at an included angle of about forty-five (45) degrees relative to the associated conductive layers 36 on the dielectric substrate 16. The reflectors 240 could also be made of solid pieces that span across all of the end-fire antenna elements 14.1 on the dielectric substrate 16, using a common shape, such as for the bi-conical reflector 230 described hereinabove. In an alternative embodiment, the multi-beam antenna $\mathbf{10}^{viii}$ may be adapted with fewer than two reflector portions 242, for example, one or none, wherein the associated dipole antenna 14.2, or alternative Yagi-Uda element, would then cooperate with the associated reflector portion 242 and, if present, one of the conductive plates 246.

Figure 44A:
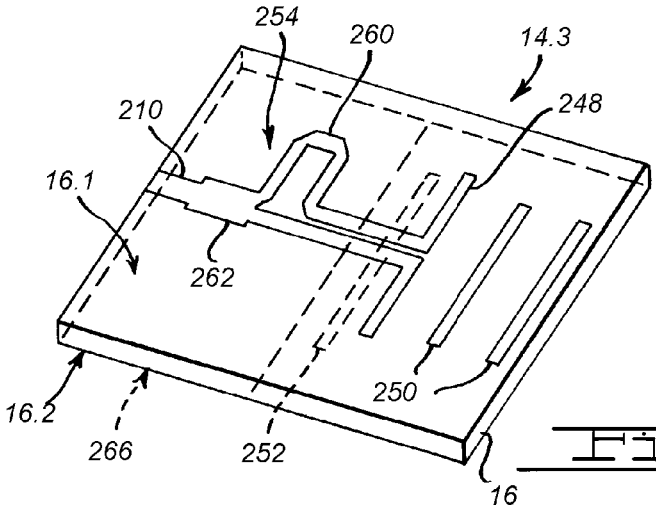
FIGS. 44*a* and 44*b* illustrate a Yagi-Uda antenna element with a first embodiment of an associated feed circuit.
Figure 44B:
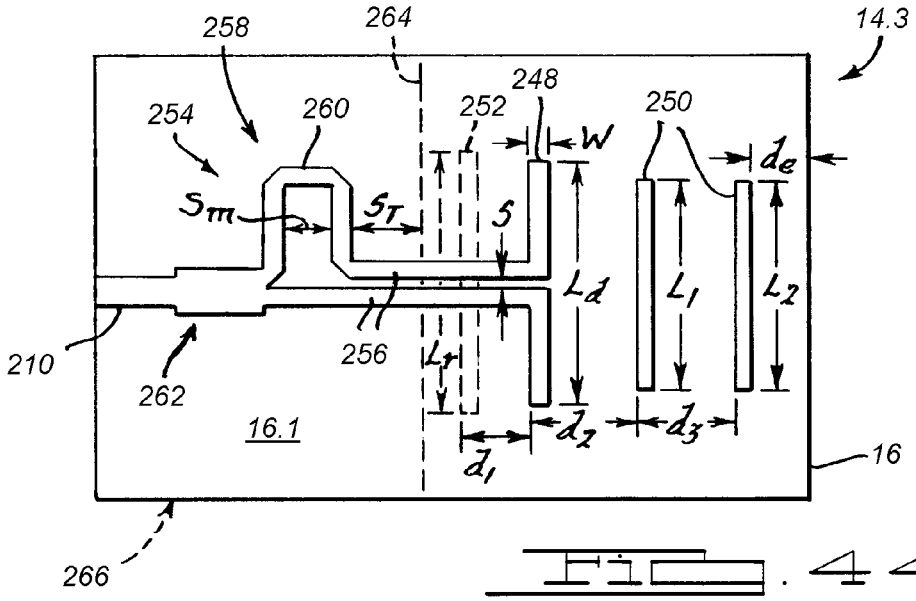

Referring to FIGS. 44*a* and 44*b*, a Yagi-Uda antenna 14.3 may be used as an end-fire antenna element 14.1 of a multi-beam antenna $\mathbf{10}^{iv}$, as described in "A 24-GHz High-Gain Yagi-Uda Antenna Array" by P. R. Grajek, B. Schoenlinner and G. M. Rebeiz in Transactions on Antennas and Propagation, May, 2004, which is incorporated herein by reference. For example, in one embodiment, a Yagi-Uda antenna 14.3 incorporates a dipole element 248, two forward director elements 250 on the first side 16.1 of the dielectric substrate 16—e.g. a 10 mil-thick DUROID® substrate—, and a reflector element 252 on the second side 16.2 of the dielectric substrate 16, so as to provide for greater beam directivity. For example, the initial dimensions of the antenna may be obtained from tables for maximum directivity in air using two directors, one reflector, and cylindrical-wire elements with a diameter d, and d/λ=0:0085, wherein the equivalent width of each element is obtained using w=2d, which maps a cylindrical dipole of diameter d to a flat strip with near-zero thickness, for example, resulting in an element width of 0.213 mm at 24 GHz. The dimensions are then scaled to compensate for the affects of the DUROID® substrate, e.g. so as to provide for the correct resonant frequency. In one embodiment, the feed gap S was limited to a width of 0.15 mm due to the resolution of the etching process.

In accordance with a first embodiment of an associated feed circuit 254, the Yagi-Uda antenna 14.3 is fed with a microstrip line 210 coupled to a coplanar stripline 256 coupled to the Yagi-Uda antenna 14.3. As described in "A new quasi-yagi antenna for planar active antenna arrays" by W. R. Deal, N. Kaneda, J. Sor, Y. Qian and T. Itoh in IEEE Trans. Microwave Theory Tech., Vol. 48, No. 6, pp. 910-918, June 2000, incorporated herein by reference, the transition between the microstrip line 210 and the coplanar stripline 256 is provided by splitting the primary microstrip line 210 into two separate coplanar stripline 256, one of which incorporates a balun 258 comprising a meanderline 260 of sufficient length to cause a 180 degree phase shift, so as to provide for exciting a quasi-TEM mode along the balanced coplanar striplines 256 connected to the dipole element 248. A quarter-wave transformer section 262 between the microstrip line 210 and the coplanar striplines 256 provides for matching the impedance of the coplanar stripline 256/Yagi-Uda antenna 14.3 to that of the microstrip line 210. The input impedance is affected by the gap spacing Sm of the meanderline 260 through mutual coupling in the balun 258, and by the proximity $S_T$ of the meanderline 260 to the edge 264 of the associated ground plane 266, wherein fringing effects can occur if the meanderline 260 of the is too close to the edge 264.

Figure 45:
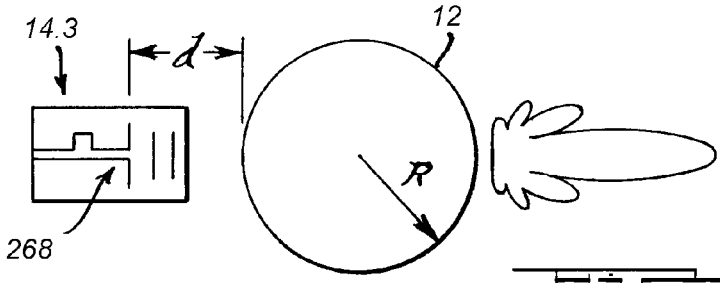
FIG. 45 illustrates the operation of the Yagi-Uda antenna element illustrated in FIGS. 44*a* and 44*b* in cooperation with a dielectric lens having a circular profile.

Referring to FIG. 45, the directivity of a Yagi-Uda antenna 14.3 can be substantially increased with an associated electromagnetic lens 12, for example, a dielectric electromagnetic lens 12 with a circular shape, e.g. a spherical, frusto-spherical or cylindrical lens, for example, that is fed from a focal plane with the phase center 268 of the Yagi-Uda antenna 14.3 at a distance d from the surface of the dielectric electromagnetic lens 12 of radius R, wherein, for example, in one embodiment, d/R=0.4.

Figure 46:
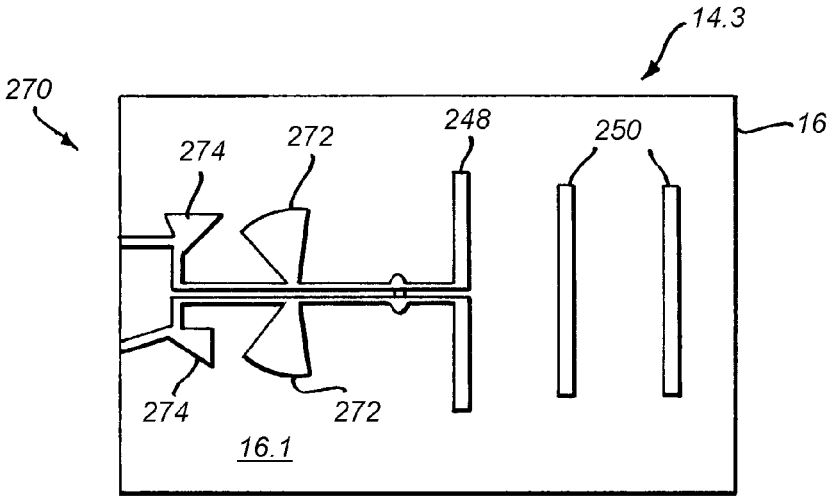
FIG. 46 illustrates a Yagi-Uda antenna element with a second embodiment of an associated feed circuit.

Referring to FIG. 46, the Yagi-Uda antenna 14.3 is used as a receiving antenna in cooperation with a second embodiment of an associated feed circuit 270, wherein a detector 224 is operatively coupled across the coplanar striplines 256 from the associated dipole element 248, and λg/4 open-stubs 272 are operatively coupled to each coplanar stripline 256 at a distance of λg/4 from the detector 224, which provides for an RF open circuit at the detector 224, and which provides for a detected signal at nodes 274 operatively coupled to the associated coplanar striplines 256 beyond the λg/4 open-stubs 272.

Figure 47:
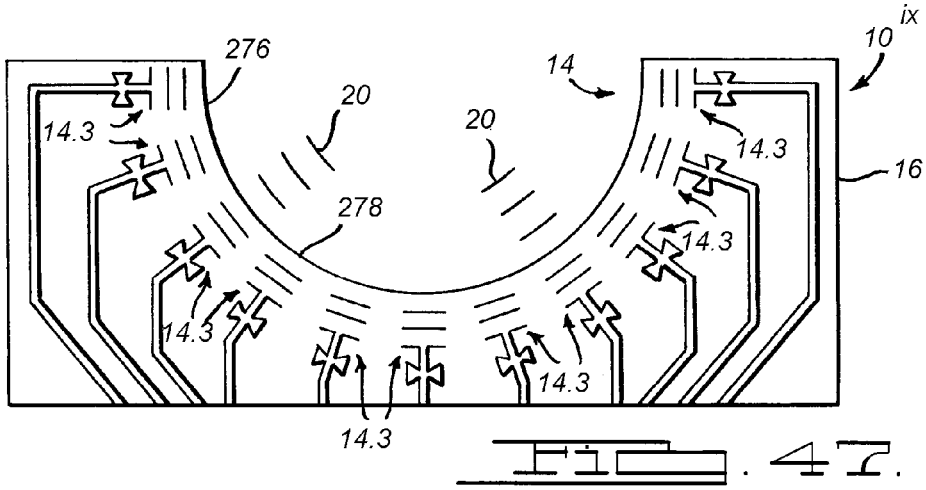
FIG. 47 illustrates an embodiment of a tenth aspect of a multi-beam antenna incorporating a plurality of Yagi-Uda antenna elements on a concave edge of a dielectric substrate.

Referring to FIG. 47, in accordance with a tenth aspect, a multi-beam antenna $\mathbf{10}^{ix}$ comprises a dielectric substrate 16 having a concave profile 276—e.g. circular, semi-circular, quasi-circular, elliptical, or some other profile shape as may be required—with a plurality of end-fire antenna elements 14.1, for example, Yagi-Uda antennas 14.3 constructed in accordance with the embodiment illustrated in FIGS. 44*a* and 44*b*, with a second embodiment of the feed circuit 270 as illustrated in FIG. 46, so as to provide for receiving beams of electromagnetic energy 20 from a plurality of associated different directions corresponding to the different azimuthal directions of the associated end-fire antenna elements 14.1 arranged along the edge 278 of the concave profile 276. The embodiment of the multi-beam antenna $\mathbf{10}^{ix}$ illustrated in FIG. 47 comprises an 11-element array of Yagi-Uda antennas 14.3 that are evenly spaced with an angular separation of 18.7 degrees so as to provide for an associated −6 dB beam cross-over.

Figure 48:
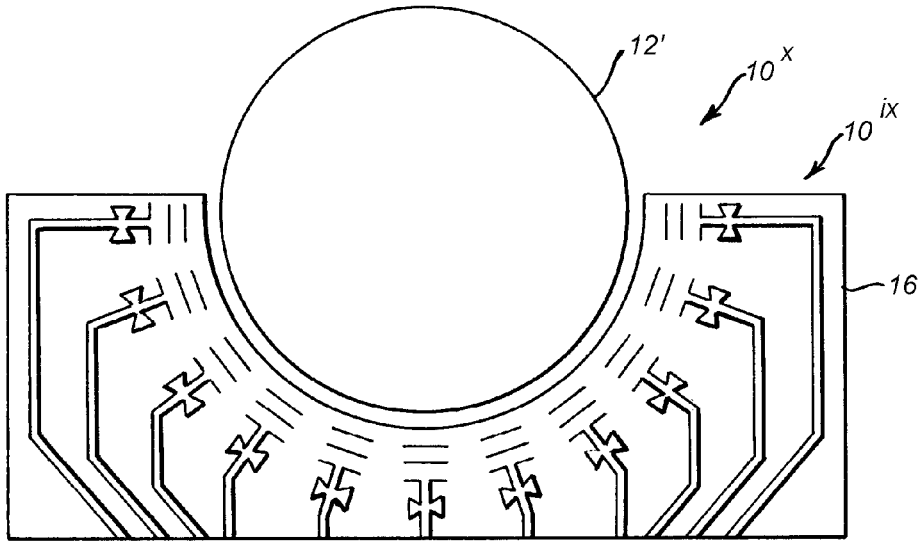
FIG. 48 illustrates an embodiment of an eleventh aspect of a multi-beam antenna incorporating a plurality of Yagi-Uda antenna elements on a concave edge of a dielectric substrate, in cooperation with an at least partially spherical dielectric lens.

Referring to FIG. 48, in accordance with an eleventh aspect of a multi-beam antenna $\mathbf{10}^{x}$, the multi-beam antenna $\mathbf{10}^{ix}$ of the tenth aspect, for example, as illustrated in FIG. 47, is adapted to cooperate with an at least partially spherical electromagnetic lens 12', for example, a spherical TEFLON® lens, so as to provide for improved directivity, for example, as disclosed in U.S. Pat. No. 6,424,319, which is incorporated herein by reference.

Figure 49A:
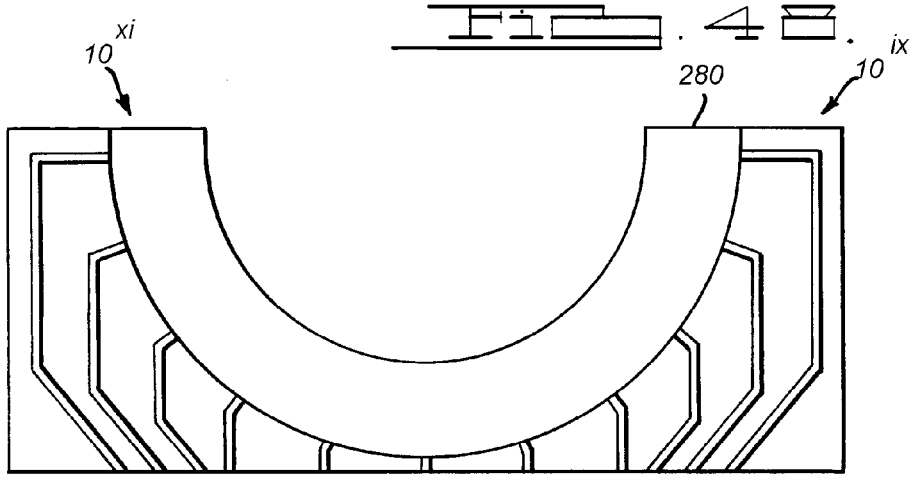
FIGS. 49*a* and 49*b* illustrate an embodiment of a twelfth aspect of a multi-beam antenna incorporating a plurality of endfire antenna elements on a concave edge of a dielectric substrate, in cooperation with an associated bi-conical reflector.
Figure 49B:
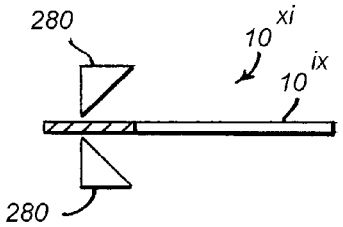

Referring to FIGS. 49*a* and 49*b*, in accordance with an twelfth aspect of a multi-beam antenna $\mathbf{10}^{xii}$, the multi-beam antenna $\mathbf{10}^{ix}$ of the tenth aspect, for example, as illustrated in FIG. 47, is adapted to cooperate with a concave bi-conical reflector 280, so as to provide for reducing the associated beam-width in the H-plane, for example, as disclosed hereinabove in accordance with the embodiment illustrated in FIGS. 38*a* and 38*b*. Alternatively, all or part of the concave bi-conical reflector 280 may be replaced with out-of-plane reflectors 240, for example, as disclosed hereinabove in accordance with the embodiment illustrated in FIGS. 43*a* and 43*b*.

Figure 50:
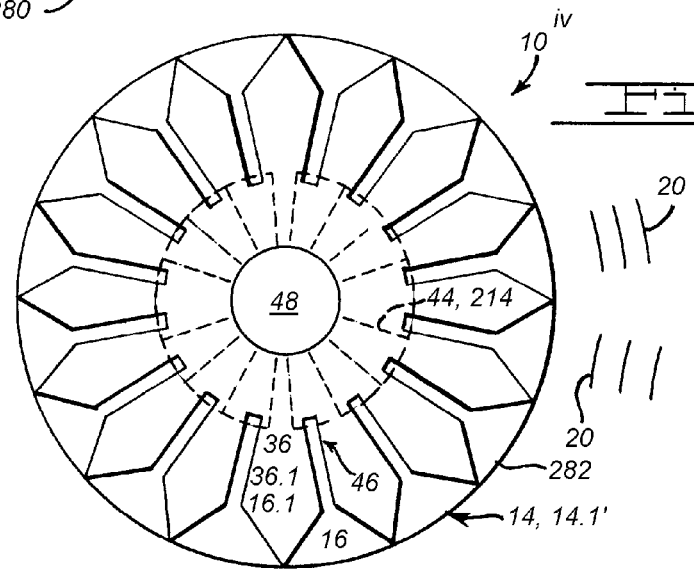
FIG. 50 illustrates a circular multi-beam antenna.
Figure 51A:
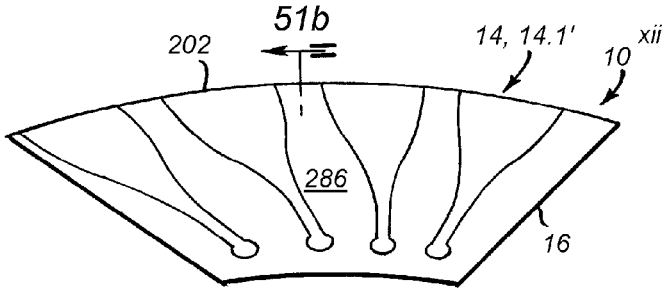
FIGS. 51*a* and 51*b* illustrate a first non-planar embodiment of a thirteenth aspect of a multi-beam antenna.
Figure 51B:
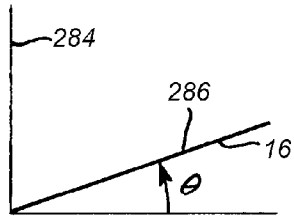
Figure 52A:
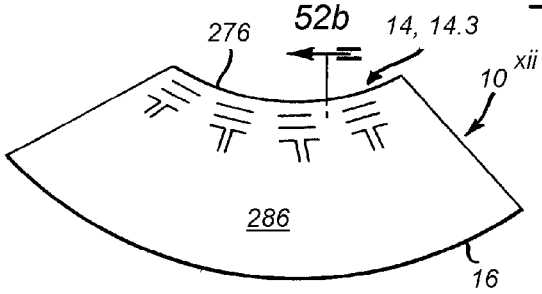
FIGS. 52*a* and 52*b* illustrate a second non-planar embodiment of the thirteenth aspect of a multi-beam antenna.
Figure 52B:
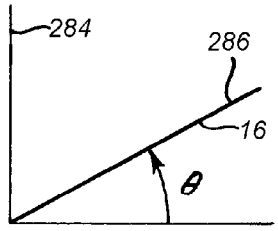
Figure 55A:
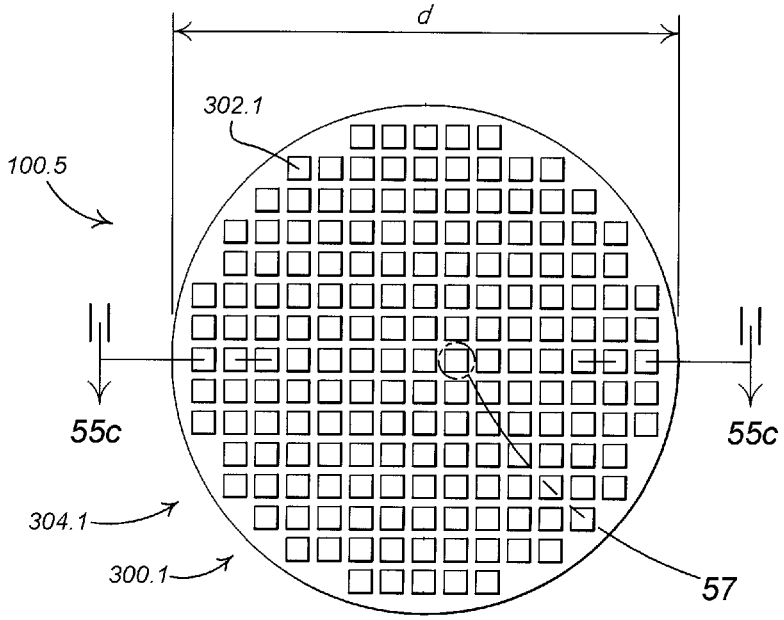
FIG. 55*a* illustrates a plan view of a fifth embodiment discrete lens array.
Figure 55B:
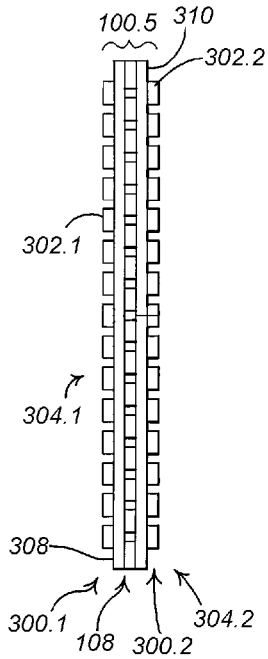
FIG. 55*b* illustrates a side view of the fifth embodiment of the discrete lens array.
Figure 55C:
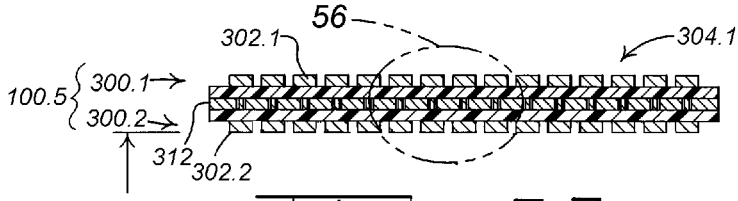
FIG. 55*c* illustrates a side cross-sectional view of the fifth embodiment of the discrete lens array, illustrating a sixth embodiment of associated discrete lens antenna elements incorporated therein.
Figure 56:
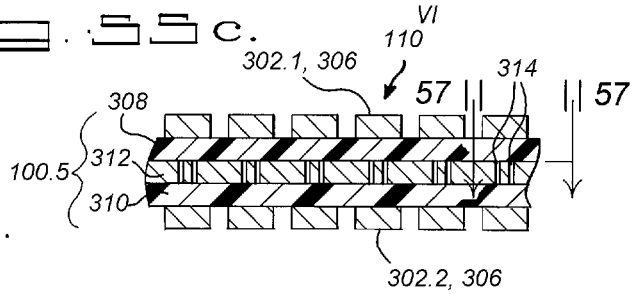
FIG. 56 illustrates an expanded fragmentary cross-sectional side view of a portion of the fifth embodiment of the discrete lens array, and the sixth embodiment of associated discrete lens antenna elements, illustrated in FIG. 55*c*.
Figure 57:
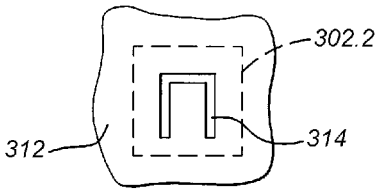
FIG. 57 illustrates an expanded cross-sectional plan view of a portion of the sixth embodiment of associated discrete lens antenna element illustrated in FIG. 56.

Referring to FIG. 50, in accordance with a second embodiment of the fifth aspect, the multi-beam antenna $\mathbf{10}^{iv}$ comprises a dielectric substrate 16 with a convex profile 202, for example, a circular, quasi-circular or elliptical profile, wherein an associated plurality end-fire antenna elements 14.1 etched into a first conductive layer 36.1 on the first side 16.1 of the dielectric substrate 16 are distributed around the edge 282 of the dielectric substrate 16 so as to provide for omni-directional operation. The plurality of end-fire antenna elements 14.1 are adapted to radiate a corresponding plurality of beams of electromagnetic energy 20 radially outwards from the convex profile 202 of the dielectric substrate 16, or to receive a corresponding plurality of beams of electromagnetic energy 20 propagating towards the convex profile 202 of the dielectric substrate 16. For example, in one set of embodiments, the end-fire antenna elements 14.1 are arranged so that the associated radiation patterns intersect one another at power levels ranging from −2 dB to −6 dB, depending upon the particular application. The number of end-fire antenna elements 14.1 would depend upon the associated beamwidths and the associated extent of total angular coverall required, which can range from the minimum azimuthal extent covered by two adjacent end-fire antenna elements 14.1 to 360 degrees for full omni-directional coverage.

One or more 1:N (for example, with N=4 to 16) switching networks 48 located proximate to the center of the dielectric substrate 16 provide for substantially uniform associated transmission lines 44 from the switching network 48 to the corresponding associated end-fire antenna elements 14.1, thereby providing for substantially uniform associated losses. For example, the switching network 48 is fabricated using either a single integrated circuit or a plurality of integrated circuits, for example, a 1:2 switch followed by two 1:4 switches. For example, the switching network 48 may comprise either GaAs P-I-N diodes, Si P-I-N diodes, GaAs MESFET transistors, or RF MEMS switches, the latter of which may provide for higher isolation and lower insertion loss. The associated transmission line 44 may be adapted to beneficially reduce the electromagnetic coupling between different transmission lines 44, for example by using either vertical co-axial feed transmission lines 44, coplanar-waveguide transmission lines 44, suspended stripline transmission lines 44, or microstrip transmission lines 44. Otherwise, coupling between the associated transmission lines 44 can degrade the associated radiation patterns of the associated end-fire antenna elements 14.1 so as to cause a resulting ripple in the associated main-lobes and increased associated sidelobe levels thereof. An associated radar unit can be located directly behind the switch matrix on either the same dielectric substrate 16 (or on a different substrate), so as to provide for reduced size and cost of an associated radar system. The resulting omni-directional radar system could be located on top of a vehicle so as to provide full azimuthal coverage with a single associated multi-beam antenna $\mathbf{10}^{iv}$.

Referring to FIGS. 51*a*, 51*b*, 52*a* and 52*b*, in accordance with a thirteenth aspect of a multi-beam antenna $\mathbf{10}^{xii}$, the dielectric substrate 16 can be angled in the vertical direction, either upward or downward in elevation, for example, so as to provide for eliminating or reducing associated ground reflections, also known as clutter. For example, referring to FIGS. 51*a* and 51*b*, the dielectric substrate 16 of a multi-beam antenna $\mathbf{10}^{iv}$ with a convex profile 202 may be provided with a conical shape so that each of the associated end-fire antenna elements 14.1 is oriented with an elevation angle towards the associated axis 284 of the conical surface 286, for example, so as to provide for orienting the associated directivity of the associated end-fire antenna elements 14.1 upwards in elevation. Also for example, referring to FIGS. 52*a* and 52*b*, the dielectric substrate 16 of a multi-beam antenna $\mathbf{10}^{iv}$ with a concave profile 276 may be provided with a conical shape so that each of the associated end-fire antenna elements 14.1 is oriented with an elevation angle towards the associated axis 284 of the conical surface 286, for example, so as to provide for orienting the associated directivity of the associated end-fire antenna elements 14.1 upwards in elevation. Accordingly, the dielectric substrate 16 of the multi-beam antenna $\mathbf{10}^{iv\text{-}xii}$ need not be planar.

Referring to FIGS. 53*a* and 53*b*, in accordance with a fourteenth aspect, a multi-beam antenna $\mathbf{10}^{xiii}$ is similar to the fifth and ninth aspects described hereinabove, except that the associated end-fire antenna elements 14.1 comprise a plurality of monopole antennas 14.4 that are coupled to, and which extend from, the associated circuit traces 38 on the first side 16.1 of the dielectric substrate 16 of the associated transmission lines 44 that provide for feeding the monopole antennas 14.4 from the associated switch network 48. For example, each circuit trace 38 in cooperation with the second conductive layer 36.2 on the second side 16.2 of the dielectric substrate 16 constitutes a microstrip line 210 that provides the associated transmission line 44. The monopole antennas 14.4 extend, from the first side 16.1 of the dielectric substrate 16, substantially normal to the second conductive layer 36.2 on the second side 16.2 of the dielectric substrate 16, which cooperates therewith as an associated ground plane thereof. Each monopole antenna 14.4 also cooperates with an associated corner reflector 244.1 that extends from, and is coupled to—e.g. using solder or conductive epoxy,—or a continuation of, the first conductive layer 36.1 on the first side 16.1 of the dielectric substrate 16, which, for example, may also be electrically connected to the second conductive layer 36.2 on the second side 16.2 of the dielectric substrate 16, wherein, in accordance with the fourteenth aspect, the vertex 288 of the corner reflector 244.1 is aligned substantially parallel to the associated monopole antenna 14.4. For example, the sides of the corner reflector 244.1 are illustrated at an included angle therebetween of about ninety (90) degrees. Each corner reflector 244.1 provides for azimuthally shaping the radiation pattern of associated monopole antenna 14.4, which is directed outwards, for example, radially outwards, from the convex profile 202 of the dielectric substrate 16. Furthermore, an associated reflector portion 242 is etched in the first conductive layer 36.1 proximate to each monopole antenna 14.4, wherein the edge of the reflector portion 242 is aligned with the associated corner reflector 244.1.

Referring to FIGS. 54*a* and 54*b*, in accordance with a fifteenth aspect, a multi-beam antenna $\mathbf{10}^{xiv}$ is similar to the multi-beam antenna $\mathbf{10}^{xiii}$ in accordance with the fourteenth aspect, except that instead of, or in addition to, the corner reflector 244.1 of the fourteenth aspect, a planar corner reflector 244.2 extending from the first side 16.1 of the dielectric substrate 16 and coupled to—e.g. using solder or conductive epoxy,—or a continuation of, the first conductive layer 36.1, provides for shaping the elevation radiation pattern of each associated monopole antenna 14.4. For example, the planar corner reflector 244.1 is illustrated at an included angle of about forty-five (45) degrees relative to the first side 16.1 of the dielectric substrate 16, for example, with the associated vertex 288 substantially parallel to a tangent of the convex profile 202 of the dielectric substrate 16. The planar corner reflector 244.2 may be used alone, or in combination with the corner reflector 244.1 of the fourteenth aspect illustrated in FIGS. 53*a* and 53*b*, so as to provide for both shaping both the azimuthal and elevational radiation patterns of the associated monopole antenna 14.4. The planar corner reflectors 244.2 could also be integrated into a solid piece that spans across all of the monopole antennas 14.4, using a common shape, such as for the bi-conical reflector 230 described hereinabove.

The multi-beam antenna $\mathbf{10}^{iv\text{-}xiv}$ provides for a relatively wide field-of-view, and is suitable for a variety of applications. For example, the multi-beam antenna $\mathbf{10}^{iv\text{-}xiv}$ provides for a relatively inexpensive, relatively compact, relatively low-profile, and relatively wide field-of-view, electronically scanned antenna for automotive applications, including, but not limited to, automotive radar for forward, side, and rear impact protection, stop and go cruise control, parking aid, and blind spot monitoring. Furthermore, the multi-beam antenna $\mathbf{10}^{iv\text{-}xiv}$ can be used for point-to-point communications systems and point-to-multi-point communication systems, over a wide range of frequencies for which the end-fire antenna elements 14.1 may be designed to radiate, for example, 1 to 200 GHz. Moreover, the multi-beam antenna $\mathbf{10}^{iv\text{-}xiv}$ may be configured for either mono-static or bi-static operation.

While specific embodiments have been described in detail in the foregoing detailed description and illustrated in the accompanying drawings, those with ordinary skill in the art will appreciate that various modifications and alternatives to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

What is claimed is:

1. A multi-beam antenna, comprising:

a. a dielectric substrate, wherein said dielectric substrate comprises a conical surface; and b. a plurality of antenna elements on said dielectric substrate, wherein at least two of said plurality of antenna elements each comprise an end-fire antenna adapted to launch, receive, or launch and receive electromagnetic waves in or from a direction substantially away from an edge of said dielectric substrate and substantially parallel thereto so that a directivity of said multi-beam antenna is oriented upwards in elevation relative to an associated axis of revolution of said conical surface, and said direction for at least one said end-fire antenna is different from said direction for at least another said end-fire antenna.

2. A multi-beam antenna, comprising:

a. a dielectric substrate; and b. a plurality of antenna elements on said dielectric substrate, wherein at least two of said plurality of antenna elements each comprise an end-fire antenna adapted to launch, receive, or launch and receive electromagnetic waves in or from a direction substantially away from an edge of said dielectric substrate, said direction for at least one said end-fire antenna is different from said direction for at least another said end-fire antenna, said at least two of said plurality of antenna elements are located along at least a portion of said edge of said dielectric substrate, said at least a portion of said edge of said dielectric substrate is curved, said at least a portion of said edge of said dielectric substrate is concave, and said electromagnetic waves are launched or received through a region that is central to said portion of said edge of said dielectric substrate that is concave.

3. A multi-beam antenna as recited in claim 2, wherein said at least a portion of said edge of said dielectric substrate at least partially circular or elliptical.

4. A multi-beam antenna, comprising:

a. a dielectric substrate; and b. a plurality of antenna elements on said dielectric substrate, wherein at least two of said plurality of antenna elements each comprise an end-fire antenna adapted to launch, receive, or launch and receive electromagnetic waves in or from a direction substantially away from an edge of said dielectric substrate, each antenna element of said at least two of said plurality of antenna elements is oriented in a respective said direction, said electromagnetic waves are launched, received or launched and received through a region external of said dielectric substrate, said direction for at least one said end-fire antenna is different from said direction for at least another said end-fire antenna, and at least one said end-fire antenna comprises either a Yagi-Uda antenna, a dipole antenna, a helical antenna, a monopole antenna, or a tapered dielectric rod.

5. A multi-beam antenna, comprising:

a. a dielectric substrate; and b. a plurality of antenna elements on said dielectric substrate, wherein at least two of said plurality of antenna elements each comprise an end-fire antenna adapted to launch, receive, or launch and receive electromagnetic waves in or from a direction substantially away from an edge of said dielectric substrate, said direction for at least one said end-fire antenna is different from said direction for at least another said end-fire antenna, at least one said end-fire antenna comprises either a Yagi-Uda antenna, a dipole antenna, a helical antenna, a monopole antenna, or a tapered dielectric rod, and said at least one said end-fire antenna comprises a Yagi-Uda antenna, said Yagi-Uda antenna comprises a dipole element and a plurality of directors on a first side of said dielectric substrate, and at least one reflector on a second side of said dielectric substrate.

6. A multi-beam antenna, comprising:

a. a dielectric substrate; and b. a plurality of antenna elements on said dielectric substrate, wherein at least two of said plurality of antenna elements each comprise an end-fire antenna adapted to launch, receive, or launch and receive electromagnetic waves in or from a direction substantially away from an edge of said dielectric substrate, said direction for at least one said end-fire antenna is different from said direction for at least another said end-fire antenna, at least one said end-fire antenna comprises either a Yagi-Uda antenna, a dipole antenna, a helical antenna, a monopole antenna, or a tapered dielectric rod, and said at least one said end-fire antenna comprises a monopole antenna adapted to extend away from a surface of said dielectric substrate.

7. A multi-beam antenna, comprising:

a. a dielectric substrate;

b. a plurality of antenna elements on said dielectric substrate, wherein at least two of said plurality of antenna elements each comprise an end-fire antenna adapted to launch, receive, or launch and receive electromagnetic waves in or from a direction substantially away from an edge of said dielectric substrate, each antenna element of said at least two of said plurality of antenna elements is oriented in a respective said direction, said electromagnetic waves are launched, received or launched and received through a region external of said dielectric substrate, and said direction for at least one said end-fire antenna is different from said direction for at least another said end-fire antenna; and c. a switching network having an input and a plurality of outputs, said input is operatively connected to a corporate antenna feed port, and each output of said plurality of outputs is connected to a different antenna element of said plurality of antenna elements.

8. A multi-beam antenna as recited in claim 7, further comprising at least one transmission line on said dielectric substrate, wherein at least one said at least one transmission line is operatively connected to a feed port of one of said plurality of antenna elements, and each output of said plurality of outputs of said switching network is connected to a different antenna element of said plurality of antenna elements via said at least one transmission line.

9. A multi-beam antenna as recited in claim 7, wherein said switching network is operatively connected to said dielectric substrate.

* * * * *